US009956446B2

(12) United States Patent
Connery et al.

(10) Patent No.: US 9,956,446 B2
(45) **Date of Patent: *May 1, 2018**

(54) MIST TYPE FIRE PROTECTION DEVICES, SYSTEMS AND METHODS

(71) Applicant: Tyco Fire Products LP, Lansdale, PA (US)

(72) Inventors: Luke S. Connery, Rehoboth, MA (US); David J. Leblanc, Uxbridge, MA (US)

(73) Assignee: Tyco Fire Products LP, Lansdale, PA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/608,610

(22) Filed: Jan. 29, 2015

(65) Prior Publication Data

US 2015/0136428 A1 May 21, 2015

Related U.S. Application Data

(63) Continuation of application No. 13/142,579, filed as application No. PCT/US2010/020056 on Jan. 4, 2010, now Pat. No. 8,973,669.

(Continued)

(51) Int. Cl.
*A62C 35/00* (2006.01)
*A62C 35/64* (2006.01)

(Continued)

(52) U.S. Cl.
CPC ..... *A62C 35/64* (2013.01); *A62C 37/14* (2013.01); *A62C 99/0072* (2013.01)

(58) Field of Classification Search
CPC ..... A62C 35/64; A62C 37/14; A62C 99/0072

(Continued)

(56) References Cited

U.S. PATENT DOCUMENTS 137,095 A 3/1873 Ransom
RE6,257 E 1/1875 Parmelee (Continued)

FOREIGN PATENT DOCUMENTS

WO WO 98/18525 5/1998

OTHER PUBLICATIONS

Tyco Fire & Bldg. Products, Datasheet AQUAMIST® PACKAGE Complete Fire Protection System, 2005, 4 pages.

*Primary Examiner* — Justin Jonaitis
(74) *Attorney, Agent, or Firm* — Perkins Coie LLP

(57) ABSTRACT

Various mist-type fire protection systems for the protection of light and ordinary hazard occupancies of reduced water demand as compared to known mist type systems or sprinkler systems configured to protect the same occupancies. Three system configurations are defined by varying design criteria for the installation of: mist devices having an enlarged coverage area alone or in combination with known nozzles or sprinklers. The preferred mist devices provide for the protection of at least one of a light hazard occupancy only and a light and ordinary hazard occupancy having a ceiling with a maximum ceiling height of at least 8 ft. The preferred device include a body having a passageway defining a K-factor of less than 1 gpm/psi$^{1/2}$. The preferred device includes means for diffusing the fluid at a flux density of less than 0.1 gpm/sq. ft. for a fluid pressure at the inlet of less than 500 psi. to define a coverage area of the device of over than 132 sq. ft., preferably to a maximum of 256 sq. ft.

16 Claims, 18 Drawing Sheets

Related U.S. Application Data

(60) Provisional application No. 61/193,875, filed on Jan. 2, 2009, provisional application No. 61/193,874, filed on Jan. 2, 2009, provisional application No. 61/193,873, filed on Jan. 2, 2009.

(51) Int. Cl.
*A62C 37/14* (2006.01)
*A62C 99/00* (2010.01)

(58) Field of Classification Search
USPC ..... 169/5, 6, 7, 16, 17, 37; 239/501, 502, 239/504, 518, 522, 524, 498
See application file for complete search history.

(56) References Cited

U.S. PATENT DOCUMENTS

| | | | | |
|---|---|---|---|---|
| 269,930 | A | 1/1883 | Harris | |
| 316,581 | A | 4/1885 | Stratton | |
| 488,003 | A | 12/1892 | Gilmore | |
| 1,315,079 | A | 9/1919 | Berna | |
| 2,076,483 | A | 4/1937 | Rowley | |
| 2,310,798 | A | 2/1943 | Lewis | |
| 2,361,144 | A | 10/1944 | Lospsinger | |
| 2,726,897 | A | 12/1955 | Dupont | |
| 3,603,512 | A | 9/1971 | Ham | |
| 3,802,512 | A * | 4/1974 | Todtenkopf | A62C 37/10 169/37 |
| 4,092,003 | A | 5/1978 | Ikeuchi | |
| 4,279,309 | A | 7/1981 | Fischer | |
| 4,800,961 | A | 1/1989 | Klein | |
| 4,901,799 | A | 2/1990 | Pepi et al. | |
| 4,989,675 | A | 2/1991 | Papavergos | |
| 5,195,592 | A | 3/1993 | Fischer | |
| 5,392,993 | A | 2/1995 | Fischer | |
| 5,505,383 | A * | 4/1996 | Fischer | B05B 1/265 169/37 |
| 5,829,684 | A | 11/1998 | Fischer | |
| 5,865,256 | A | 2/1999 | Pounder | |
| 8,973,669 | B2 | 3/2015 | Connery et al. | |
| 2001/0054508 | A1 * | 12/2001 | Fischer | A62C 37/14 169/37 |
| 2008/0236846 | A1 * | 10/2008 | Gamble | A62C 5/02 169/15 |

* cited by examiner

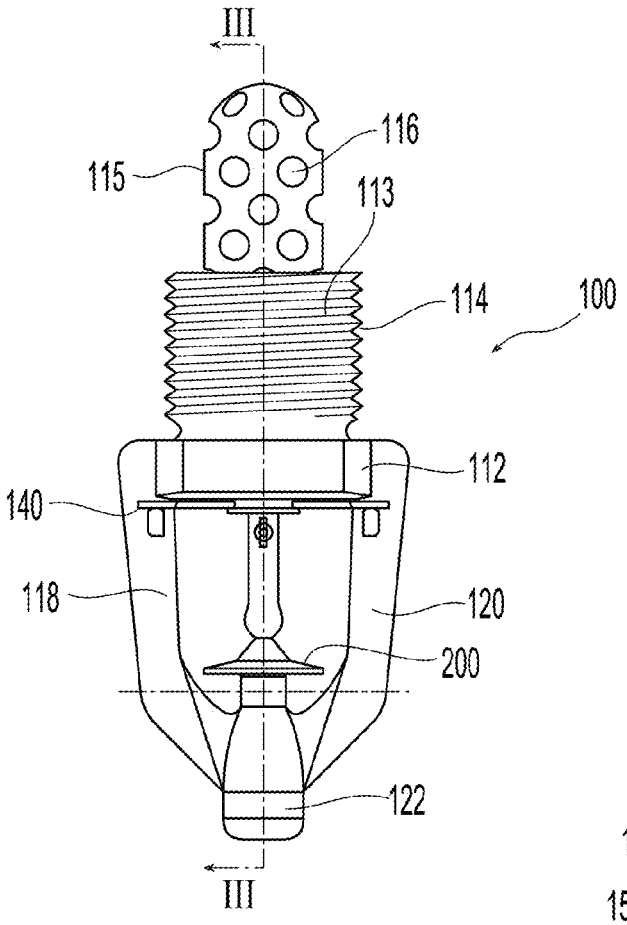
Fig. 2
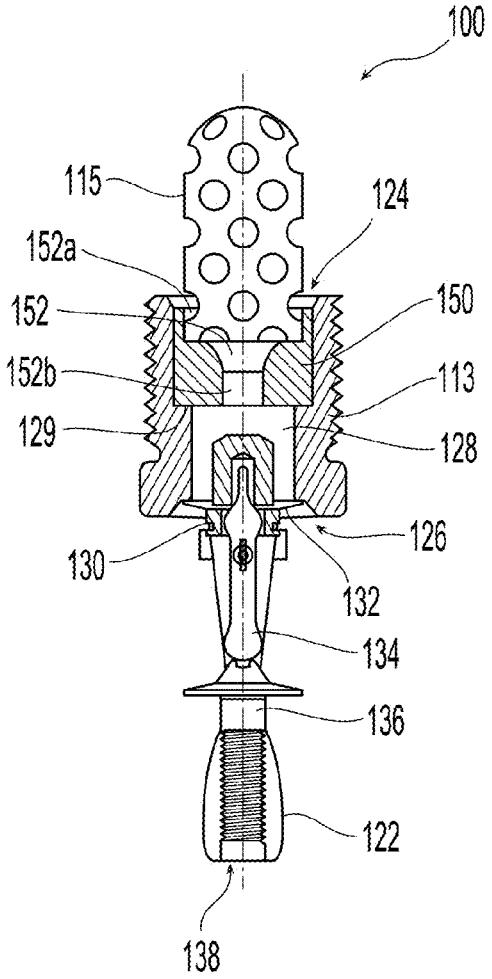

MIST TYPE FIRE PROTECTION DEVICES, SYSTEMS AND METHODS

PRIORITY DATA & INCORPORATION BY REFERENCE

This application is a continuation application of U.S. patent application Ser. No. 13/142,579, filed Sep. 13, 2011 which is an application under a 35 U.S.C. § 371 of International Application No PCT/US2010/020056, filed Jan. 4,2010, which claims the benefit of priority to U.S. Provisional Patent Application Nos. 61/193,875, filed Jan. 2, 2009, 61/193,873, filed Jan. 2, 2009 and 61/193,874, filed Jan. 2, 2009, each of which is incorporated by reference in entirety.

TECHNICAL FIELD

This invention relates to fire protection systems and methods that use manually or automatically operated nozzles for use in discharging fire-retardant liquids. More specifically, the invention relates to fire protection systems and methods for light hazard and ordinary hazard occupancies using fire protection nozzles that provide a liquid mist. Accordingly, this invention further relates to manually or automatically operated nozzles for use in discharging fire-retardant liquids, preferably water, as a water mist.

BACKGROUND OF THE INVENTION

Fire protection nozzles are used to discharge water, with or without additives, in a relatively fine spray, which is generally referred to in the industry as mist. In contrast, fire protection sprinklers discharge water as a spray of large droplets or streams of water. The fire industry further distinguishes water discharging fire protection devices as being either nozzles or sprinklers based upon the device satisfying an industry accepted performance standard. For example, devices satisfying performance test specified in Factory Mutual (FM) Global Technologies LLC publication, *Approval Standard For Water Mist Systems: Class No.* 5560 (May 2005) (hereinafter "FM 5560") are classified as water mist devices or nozzles.

The mechanism(s) by which a fine spray (water mist) acts to control, suppress or extinguish a fire can be a complex combination of two or more of the following factors, depending on the operating concept of the individual nozzle, the size of the orifice(s), the diffuser element, the operating pressure and flow rate:

1. Heat Extraction from the Fire as Water is Converted into Vapor

The amount of evaporation and hence heat withdrawn from the fire (i.e., cooling of the fuel) is a function of surface area of water droplets applied, for a given volume. Reducing droplet size increases surface area and increases the cooling effect of a given volumetric flow rate of water.

2. Reduced Oxygen Levels as the Vapor Displaces Oxygen Near the Seat of the Fire When water converts to vapor, it expands by a factor of about 1650 times, displacing and diluting oxygen, thereby blocking the access of oxygen to the fuel.

3. Deluging of the Protected Area

Small water droplets are extremely light, and tend to remain suspended with the slightest air currents. This results in a "mist" that tends to distribute itself throughout an enclosure, outside of the direct spray range of an individual nozzle. Fine water droplets are, therefore, more likely to be drawn into the seat of the fire, further enhancing the effectiveness of the systems. This three-dimensional effect of the mist distribution also acts to cool the gases and other fuels in the area, blocking the transfer of radiant heat to adjacent combustibles, as well as, pre-wetting them.

4. Direct Impingement Wetting and Cooling of Combustibles

In addition to the pre-wetting and cooling of the flames by vaporizing water droplets, fire extinguishment by direct contact of the water droplets with the burning fuel to prevent further generation of the combustible vapors is one of the modes of addressing a fire and more preferably controlling a fire normally associated with traditional sprinklers. However, with a fast response release mechanism, high momentum mist can be effective in this mode during the early development stage of exposed fires.

A known fire protection nozzle is shown and described in U.S. Pat. No. 5,392,993. Another type of known fire protection nozzle is shown and described in International PCT Patent Publication WO 98/18525. Other known fire protection nozzles are the AquaMist® nozzles from Tyco Fire Suppression & Building Products of Lansdale, Pa. (hereinafter "Tyco"). For example, the AM4 and AM10 AquaMist® nozzles were developed for the special hazards market, a segment of water spray fire protection very different than sprinklers. These nozzles provided extinguishment of Class B (flammable liquids) fires via total flooding deluge protection of machinery spaces. Other complementary AquaMist nozzles were also developed during this time period: the AM6, AM11, AM22 and AM24 nozzles were developed with International Maritime Organization (IMO standard IMO A.800(19) marine system and, later, the AM15 nozzle was developed with the IMO System 913 local application system. Previously published data sheets for each of the AM4, AM6, AM10, AM11, AM22, and AM24 nozzles and patent publications are U.S. Pat. No. 5,392,993 and WO 98/18525 are included in the U.S. Provisional Patent Application No. 61/193,873.

The AM24 nozzle was tested separately by Underwriters Laboratories for its potential to protect up to Ordinary Hazard, Group 2 (OH2) occupancies as defined in National Fire Protection Association (NFPA) publication entitled, *NFPA* 13*: Standard for the Installation of Automatic Sprinkler Systems* (NFPA 13). An AM24 arrangement was tested per UL 2167 and was found to successfully pass rigorous OH2 fire testing. The nozzle received a UL listing according to this protocol. Due to the relatively small diameter spray pattern that is characteristic of the nozzle, the listing only allowed for installations at relatively limited nozzle spacings and ceiling heights. Although fire test requirements for Light Hazard (LH) and Ordinary Hazard, Group 1 (OH1) (as defined by NFPA 13) were less severe, the AM24 had been designed for OH2 testing. The resultant installation parameters for LH and OH1 suffered the same fate, and only a small ceiling height concession was allowed.

Summarized below in the tables below are known prior AQUAMIST® Nozzles showing their installation parameters for various hazards. For each nozzle the table indicates the K-factor (in gpm/psi 1/2) the minimum operating pressure, the maximum spacing of the nozzle, the coverage area per nozzle, the effective flux density, i.e., the flow delivered per square foot by the nozzle and the maximum ceiling height under which the nozzle may be installed.

TABLE A

| AM6 | Class A fires (LH Commodity) | |
|---|---|---|
| k | 0.33 | [gpm/psi^½] |
| min. pressure | 116 | [psi] |
| Max. spacing | 5'10" | |
| max. area | 26 | [ft^2] |
| eff. flux density | 0.137 | [gpm/ft^2] |
| max. ceiling height | 8'2" | |

TABLE B

| AM11 | Class A fires (LH Commodity) | |
|---|---|---|
| K | 0.33 | [gpm/psi^½] |
| Min. pressure | 102 | [psi] |
| max. spacing | 8'2" | |
| max. area | 67 | [ft^2] |
| eff. flux density | 0.050 | [gpm/ft^2] |
| max. ceiling height | 8'2" | |

TABLE C

| AM22 | Class A fires (LH Commodity) | |
|---|---|---|
| k | 0.64 | [gpm/psi^½] |
| min. pressure | 102 | [psi] |
| Max. spacing | 11'6" | |
| max. area | 132 | [ft^2] |
| eff. flux density | 0.049 | [gpm/ft^2] |
| max. ceiling height | 8'2" | |

TABLE D

| AM22 | Class A fires (LH Commodity) | |
|---|---|---|
| k | 0.64 | [gpm/psi^½] |
| min. pressure | 102 | [psi] |
| max. spacing | 9'2" | |
| max. area | 84 | [ft^2] |
| eff. flux density | 0.077 | [gpm/ft^2] |
| Max. ceiling height | 16'5" | |

TABLE E

| AM24 | Class A fires (OH Commodity) | |
|---|---|---|
| k | 0.64 | [gpm/psi^½] |
| min. pressure | 102 | [psi] |
| max. spacing | 8'2" | |
| max. area | 67 | [ft^2] |
| eff. flux density | 0.096 | [gpm/ft^2] |
| max. ceiling height | 8'2" | |

To date, it is believed that standard setting organizations have maintained that water mist systems are to satisfy the hydraulic design criteria the greater of nine nozzles or 1500 square feet as specified by standard setting organization such as for example, Factory Mutual (FM) Global Technologies LLC or NFPA. The amount of water discharged during system operation is one of the primary concerns of water mist system designers. This is typically based on the goal of preserving the interior finish of a building or the items contained within (i.e. priceless paintings). Another goal may be providing adequate fire protection in a building with a limited volume of water. Either way, water supply can be a primary concern in choosing a water mist system over a sprinkler system.

DISCLOSURE OF INVENTION

The present invention is directed to various mist-type fire protection systems for the protection of light and ordinary hazard occupancies of reduced water demand as compared to known mist type systems or sprinkler systems configured to protect the same occupancies. Three preferred system configurations are defined by varying design criteria for the installation of: (i) two preferred mist nozzles; (ii) the preferred nozzles in combination with known nozzles; and (iii) the preferred nozzle in combination with known sprinklers.

One preferred embodiment of the mist system for fire protection of a light and ordinary hazard occupancy includes a fluid supply and a plurality of nozzles spaced about the occupancy and coupled to the fluid supply so as to provide fluid to the nozzles at an operating pressure of less than about 500 pounds per square inch (psi). The plurality of nozzles further define a hydraulic demand being the greater of: (i) five hydraulically remote nozzles each having a coverage area ranging from 36 sq. ft. to a maximum of about 256 sq. ft; or (ii) a hydraulic design area ranging from about 900 square feet to about 1044 square feet. In one aspect of the preferred embodiment, the plurality of nozzles are disposed above a protection area of the occupancy at a maximum ceiling height of under ten feet to define a nozzle-to-nozzle spacing being a minimum six feet by six feet (6 ft.×6 ft.) and a maximum spacing of 16 feet by 16 feet (16 ft.×16 ft.) and the hydraulic demand is the greater of five hydraulic remote nozzles or 900 sq. ft (84 sq. m). In alternative embodiment of the preferred system, the maximum ceiling height is about ten feet, more specifically 9 ft-10 in. (3 m) or less, or further in the alternative 8 ft (2.4 m). The operating pressure for the plurality of nozzles preferably ranges from about 110 psi. to about 250 psi. or alternatively from 140 psi. to about 250 psi. In one aspect, the preferred nozzles have plurality of nozzles have a K-factor of less than 1 gpm/psi$^{1/2}$, specifically about 0.8 gpm/psi$^{1/2}$. Alternatively, the plurality of nozzles have a K-factor of about 0.6 gpm/psi$^{1/2}$.

In one aspect of the system, the plurality of nozzles provide mist-type fire protection for the occupancy having a compartmented area at a maximum of over 1000 square feet and more particularly 1024 sq. ft. For one particular embodiment in which the hydraulic demand is defined by a water duration of sixty minutes to all the nozzles in the protection area, the system is preferably configured so as to provide protection to a light hazard only occupancy.

In another aspect of the preferred system, the plurality of nozzles are disposed above a protection area of the occupancy at a maximum ceiling height of about seventeen feet to define a minimum nozzle-to-nozzle spacing of six feet by six feet (6 ft.×6 ft.) and a maximum nozzle-to-nozzle spacing of 12 feet by 12 feet (12 ft.×12 ft.). Each of the plurality of nozzles have a K-factor of about 0.6 gpm/psi$^{1/2}$, and more particularly 0.59 gpm/psi$^{1/2}$. In one particular embodiment, wherein the protection area is less than 1500 square feet, the hydraulic demand is defined by a water duration of sixty minutes to all the nozzles in the protection area so as to provide protection to a light hazard only occupancy.

Another preferred mist system provides for fire protection of light and ordinary hazard occupancy defining a protection area being at least one of: (i) greater than 1024 sq. ft and (ii) beneath a ceiling having a maximum ceiling height of about 13 ft. or less. The system preferably includes a fluid supply, a plurality of nozzles coupled to the fluid supply to define a hydraulic demand of the system being the greater of: (i) five most hydraulically remote sprinklers or a 900 square foot area. The plurality of nozzles preferably include a first plurality of nozzles spaced about the occupancy to protect no more than 30% of the protection area at a nozzle to nozzle spacing ranging between about 6 ft×6 ft. to about 12 ft.×12 ft., each having an operating pressure in the range of about 102 psi. to about 250 psi. A second plurality of nozzles spaced about the occupancy for the protection of a remainder of the protection area at a nozzle to nozzle spacing ranges between about 6 ft×6 ft. to about 16 ft.×16 ft. each at an operating pressure in the range of about 110 psi. to about 250 psi.

In one aspect, where the protection area is no more than 1024 sq. ft. and the maximum ceiling height is about ten feet, the second plurality of nozzles are spaced at a nozzle to nozzle spacing ranging between about 6 ft×6 ft. to about 16 ft.×16 ft. with each of the nozzles at an operating pressure in the range of about 140 psi. to about 250 psi. In yet another aspect of the preferred systems, the second plurality of nozzles are spaced about the occupancy at a nozzle to nozzle spacing ranging between about 6 ft×6 ft. to about 12 ft.×12 ft., the second plurality of nozzles being coupled to the fluid supply so as to provide the fluid to the nozzles at an operating pressure in the range of about 110 psi. to about 250 psi.

In one particular preferred system for protection of an ordinary hazard without storage and the maximum ceiling height is about ten feet, the first plurality of nozzles have a maximum nozzle to nozzle spacing of about 12 ft.×12 ft. In another aspect in which the occupancy is ordinary hazard without storage and the maximum ceiling height is about 13 ft., the first plurality of nozzles having a maximum nozzle to nozzle spacing of about 10 ft.×10 ft. In yet another aspect of the preferred system for mist type protection of an occupancy is ordinary hazard with storage having a maximum storage height of 8 ft. and the maximum ceiling height is about ten feet, the first plurality of nozzles having a maximum nozzle to nozzle spacing of about 8 ft.×8 ft.

In another aspect of the system, where the occupancy is ordinary hazard without storage and the maximum ceiling height is about ten feet, the first plurality of nozzles having a maximum nozzle to nozzle spacing of about 10 ft.×10 ft. Alternatively, wherein the occupancy is ordinary hazard without storage and the maximum ceiling height is about 13 ft., the first plurality of nozzles have a maximum nozzle to nozzle spacing of about 8 ft.×8 ft. Wherein the occupancy is ordinary hazard with storage having a maximum storage height of 5 ft., the ceiling height is about eight feet (8 ft.) and the first plurality of nozzles have a maximum nozzle to nozzle spacing of about 8 ft.×8 ft.

Another preferred system provides a mist for fire protection of a light and ordinary hazard occupancy preferably defining a protection area of greater than 1024 sq. ft. The system preferably includes a fluid supply and a plurality of fluid distribution devices coupled to the fluid supply. The devices includes a plurality of sprinklers spaced about the occupancy to protect no more than 30% of the protection area at a sprinkler to sprinkler spacing ranging between about 6 ft×6 ft. to about 15 ft.×15 ft. The plurality of sprinklers are coupled to the fluid supply so as to define a hydraulic demand of the system being the greater of the five most remote sprinkler or a design area ranging between 900 sq. ft. to 1500 sq. ft., each of the plurality of sprinklers having a maximum operating pressure of 175 psi. The preferred system further preferably includes a plurality of nozzles spaced about the occupancy for the protection of a remainder of the protection area at a nozzle to nozzle spacing ranging between about 6 ft×6 ft. to about 16 ft.×16 ft. Each of the first plurality of nozzles have an operating pressure in the range of about 110 psi. to about 250 psi. For the preferred system, the hydraulic demand is preferably defined by: (i) the greater of the five most remote sprinklers or 900 sq. ft. for a maximum ceiling height of the occupancy being about ten feet (10 ft.); (ii) the greater of the five most remote sprinklers or 1013 sq. ft. for a maximum ceiling height of fifteen feet (15 ft.); (iii) the greater of the five most remote sprinklers or 1125 sq. ft. for a maximum ceiling height of twenty feet (20 ft.).

The present invention further provides for mist devices. Generally, the preferred mist device for the protection of at least one of a light hazard occupancy only and a light and ordinary hazard occupancy having a ceiling with a maximum ceiling height of at least 8 ft. The preferred device includes a body having an upper portion and a lower portion. The upper portion defines an internal passage having an inlet and an outlet for the discharge of a fluid. An orifice insert disposed within the passageway defines a K-factor of less than 1 gpm/psi$^{1/2}$. A pair of frame arms extend between the upper and lower body portion and centered about the device axis, and a seal assembly is disposed in the outlet including a thermally sensitive element to support the seal assembly. The preferred device includes means for diffusing the fluid at a flux density of less than 0.1 gpm/sq. ft. for a fluid pressure at the inlet of less than 500 psi. to define a coverage area of the device of over than 132 sq. ft., preferably to a maximum of 256 sq. ft.

In one preferred embodiment, a diffuser assembly defining a coverage area of the device of maximum of 256 sq. ft. at a maximum ceiling height of about ten feet for an operating fluid pressure at the inlet ranging between 140 psi. to 250 psi., the diffuser assembly including: a load screw engaged with the lower body portion and a diffuser element disposed atop the load screw internally of the frame arms centrally aligned along the device axis. The diffuser element preferably includes an upper surface and a lower surface, the upper surface including a central cone portion extending proximally toward the outlet of the passageway; and a plurality of through holes. Each through hole is preferably defined by a pair of circles partially overlapping one another, the pair of circles having different diameters so as to form a key-hole shaped through hole. Moreover, the plurality of through holes includes a first pair of diametrically opposed through holes, a second pair of diametrically opposed through holes disposed perpendicular to the first pair. Preferably each of the first and second pair of through holes are disposed at a forty-five degree angle relative to the pair of frame arms. The preferred device further preferably includes a plurality of touchdown regions, each touchdown region surrounding a through hole. A plurality of channels are preferably formed along the upper surface and radially disposed about the diffuser element such that adjacent converging channels having an overlapping portion such that the adjacent converging channels are in communication with one another, a through hole and touchdown being centered between adjacent diverging channels. The preferred device preferably includes an orifice insert disposed within the passageway to define a K-factor ranging between 0.7 to about 0.9 gpm/psi$^{1/2}$.

In another preferred embodiment, the means preferably includes a diffusing element having an upper surface and a lower surface spaced from and extending substantially parallel to the upper surface. The upper surface preferably defines a central region, an outer region and an intermediate region extending at an angle to each of the central and peripheral regions to space the central and peripheral regions axially apart. The upper surface preferably extends about the device axis so as to define a truncated cone about the device axis. At least one of a plurality of slots and a plurality of through holes extend from the upper surface to the lower surface. Each of the plurality of slots preferably have a slot opening along the outer region that extends radially inward toward the device axis to define a slot length, an initial portion, an intermediate portion and a terminal portion, each of the plurality slots defining slot widths from the initial to the terminal portion. The plurality of slots further preferably include a first group of slots and at least a second group of slots in which the slot width of the first group of slots varying along the slot length, the slot width of the second group of slots being constant along the slot lengths. The first group of slots preferably includes radiused portions in the terminal portion of the slot, the radiused portions being spaced apart such that the slot width of the terminal portion is wider than the slot width in the initial and intermediate portions.

Preferably, the first group of slots includes a first type of slot, a second type of slot, and a third type of slot. The first type of slots are preferably centered along a first axis aligned with the frame arms and centered along a second axis perpendicular to the first axis. The second type of slots having a slot width wider at the terminal portion that is wider than the slot width of the terminal portion of the first type of slot. The second type of slot is centered along a third axis disposed at a 45 degree angle between the first and second axes. The third type of slots preferably has a slot width at the terminal portion that is smaller than the slot width of the terminal portion of the first type of slot. The third type of slot is preferably disposed between the second type of slot and the first type of slot disposed along the first axis. A slot of the second group is preferably disposed between the second type of slot and the first type of slot disposed along the second axis.

The preferred diffuser element includes a third group of slots having an initial portion in communication with a first type of slot disposed along the first axis, the slot width of the third type of slots widening from the initial portion to the terminal portion of the slots. The third group of slots are preferably aligned with the pair of frame arms such that the second type of slots are disposed at a forty-five degree angle relative to the pair of frame arms.

For the preferred diffuser element, each of the plurality of through holes is elongated to define a major axis and a minor axis, each of the through holes including a pair of radiused end portions having centers of curvature spaced along a major axis. The plurality of through holes preferably include a first group of through holes and at least a second group of through holes, the pair of radiused end portions of the first group of through holes having equal radii, the pair of radiused end portions of the second group of through holes having varying radii. The preferred device further includes an orifice insert disposed within the passageway distally of the inlet to define the K-factor, the K-factor ranging between 0.5 to about 0.7 gpm/psi$^{1/2}$. Each of the preferred nozzles and their diffusing structure provide for fluid distribution pattern and effective flux density that satisfies industry accepted fire tests. In addition, the preferred nozzles when subjected to a preferred distribution test, their diffusing structures deliver a flow, more specifically an effective flux, at a radial distance from the nozzle in an amount that has not been believed to be previously realized.

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

FIG. 2 is an elevation view of a preferred embodiment of a nozzle.

FIG. 3 is a cross-sectional view of the nozzle of FIG. 1 along axis III-III.

MODE(S) FOR CARRYING OUT THE INVENTION

Figure 1:
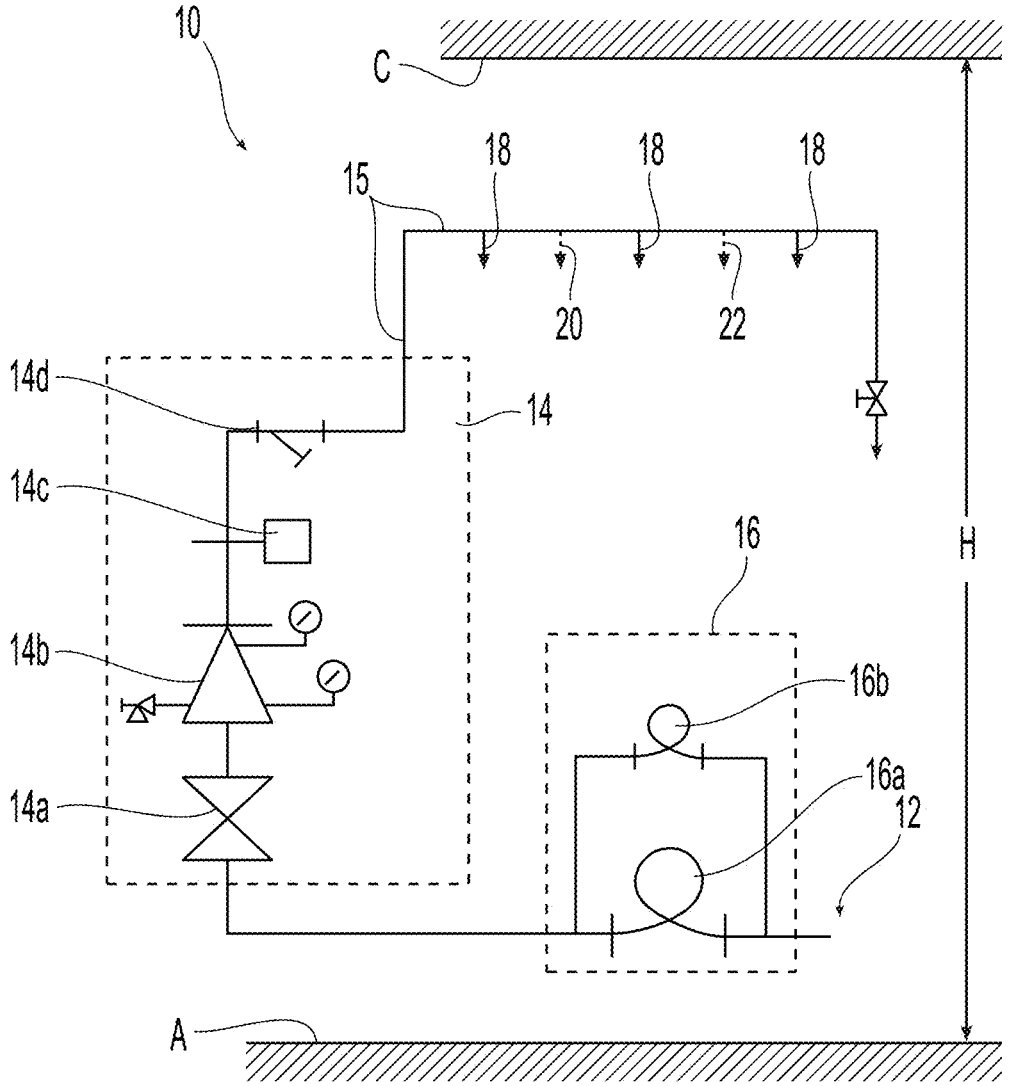
FIG. 1 is a schematic view of a preferred fire protection system.

Shown in FIG. 1 is a schematic illustration of a preferred embodiment of a fire protection system 10 that employs one or more of mechanisms of fire fighting with a mist, as described above. The system 10 is preferably configured to provide fire protection of light hazard occupancies. Light hazard occupancies are normally defined as occupancies or portions of other occupancies where the quantity and/or combustibility of contents is low and fires with relatively low rates of heat release are expected. Light hazard occupancies typically include but are not limited to the following: residential, offices, data processing areas without open storage of information media, meeting rooms, hotels, museum exhibit areas, restaurant seating areas, institutions, and schools. More preferably, the system 10 provides fire protection of both light hazard and ordinary hazard occupancies. Ordinary hazard occupancies are normally defined as occupancies or portions of other occupancies where combustibility is moderate, quantity of combustibles is moderate to high, and fires with moderate rates of heat release are expected. Ordinary hazard occupancies typically include but are not limited to the following: automobile parking, laundries, libraries, maintenance areas, mercantile, laboratories, incidental storage, restaurant service areas (kitchens), and dry cleaners. NFPA 13 classifies and defines ordinary hazard occupancies as being into two groups: Group 1 Ordinary Hazard occupancies (OH1) and Group 2 Ordinary Hazard Occupancies. (OH2). OH1 occupancies are defined as occupancies or portions of other occupancies "where combustibility is low, quantity of combustibles is moderate, stockpiles of combustible do not exceed 8 ft. (2.4 m) and fires with moderate rates of heat release are expected." See NFPA 13, Ch. 4 (2007). OH2 occupancies shall be defined as occupancies or portions of other occupancies "where the quantity and combustibility of contents are moderate to high, where stockpiles of contents with moderate rates of heat release do not exceed 12 ft (3.66 m) and stockpiles of contents with high rates of heat release do not exceed 8 ft (2.4 m)." See NFPA 13, Ch. 4 (2007).

The preferred system 10 includes a fluid control center 14 for controlling the flow of fire fighting fluid between a fluid supply 12 and one or more misting devices such as for example, preferred nozzles 18, 18' that are, alone or in combination with one or more known nozzles 20, and interconnected with the water control center 14 by a network of pipes 15. The preferred system may further include one or more sprinklers 22 coupled to the fluid control center 14. The system 10 is preferably a wet system such that the water control center is normally open so as to fill the network of pipes with the fire fighting fluid and deliver a working pressure of fluid to the nozzles and when applicable, sprinklers. Material for the piping is preferably any one of CPVC, brass and copper pipe, copper tubing, stainless steel pipe, or other material suitable for use in a mist system.

A preferred fluid control center 14 includes a control valve 14*a* and one or more of the following components: a water check valve 14*b*, a fluid flow detector 14*c* and a system strainer 14*d*. The fluid supply 12 can be water, for example, provided by a municipal water supply connection. The fluid supply 12 is preferably sized to provide a minimum water supply duration of at least ten minutes and more preferably at least a thirty minute water supply duration to the system 10. Moreover, the fluid supply 12 is sufficient to deliver a pressure of up to about 250 psi to each nozzle or sprinkler device, preferably ranging between about 140 psi to about 250 psi., more preferably ranging from about 110 psi to about 250 psi, and even more preferably ranging from about 102 psi to about 250 psi. To ensure that water is delivered to the nozzles at a sufficient pressure, the system 10 further preferably includes a pump 16 located between the supply 12 and the fluid control center 14. In one preferred embodiment, the pump 16 includes a main pump 16*a* and controller and a jockey pump 16*b* and controller. The system 10 is preferably sized to provide light and ordinary hazard protection to an occupancy area of no more than 52,000 square feet. The occupancy may include one or more compartmented areas that are interconnected by corridors. Provided that the all the occupancies and corridors of the system do not exceed the 52,000 square foot maximum, a single fluid control center is believed to be sufficient to supply the fluid devices of the system.

Coupled downstream of the fluid control center 14 is a network of mist generating devices or nozzles 18 that are preferably installed in accordance with NFPA Publication *NFPA* 750*: Water Mist Fire Protection Systems* ("NFPA 750"). The nozzles 18, 20, and where applicable sprinklers 22, are preferably all pendent devices that are installed beneath the ceiling C above a protection area A at a maximum ceiling height H of the occupancy being protected. The preferred ceiling construction is smooth with a maximum slope of about five percent or 1 foot rise for each twelve feet of run. Alternatively, the nozzles 18 can be a combination of pendent type, upright orientation and sidewall nozzles.

The mist-type fire protection systems described below provide for the protection of light and ordinary hazard occupancies of reduced water demand as compared to known mist type systems or sprinkler systems configured to protect the same occupancies. Three preferred system configurations are defined by varying design criteria for the installation of: (i) two preferred and mist nozzles; (ii) the preferred nozzles in combination with known nozzles; and (iii) the preferred nozzle in combination with known sprinklers.

In one aspect of the preferred system 10, the nozzles 18 are installed and configured so as to provide fire protection for light and ordinary hazard occupancies using low pressure (<175 psi) and/or low to intermediate pressure (175 psi.<x<500 psi.) nozzles having a coverage area per nozzle that is preferably over 132 sq. ft for installations beneath ceilings having a maximum ceiling height of about seventeen feet, preferably under ten feet (10 ft.), preferably about nine feet ten inches (9 ft-10 in.), and alternatively about eight feet and more particularly about 8 ft-2 in. The preferred nozzles 18 in particular define a coverage area per sprinkler that ranges from a minimum 36 square feet to a maximum 256 square feet. In the preferred system 10, the nozzles 18 are preferably coupled to the fluid supply 12 and located about the occupancy so as to define a preferred hydraulic demand of the system that is the greater of the most remote five nozzles or a hydraulic design area ranging between about 900 sq. ft. to about 1044 sq. ft. The hydraulic demand is further preferably defined by the ceiling height of the occupancy and the performance characteristics of the nozzle 18 and more particularly the coverage area for the nozzle for a given maximum ceiling height. Accordingly, the system 10 and its preferred design criteria provides for mist type fire protection with a reduced hydraulic demand as compared to mist systems that use the known mist design criteria of hydraulically designing to the greater of nine nozzles or 1500 square feet as specified by standard setting organization such as for example, FM or NFPA and/or known sprinkler systems for configured to protect similar occupancies.

One preferred embodiment of design criteria of the system 10 provides mist type fire protection for a light hazard and ordinary hazard occupancy having a maximum compartmented protection area of about 1000 square feet (sq. ft.) and more preferably 1024 square ft (sq. ft.) beneath a ceiling having a maximum ceiling height of about ten feet (10 ft.), preferably about nine feet ten inches (9 ft-10 in.), and alternatively about eight feet. The design criteria more specifically provides that the nozzles 18 are disposed beneath the ceiling at a nozzle-to-nozzle spacing that ranges from a minimum six feet-by-six feet (6 ft.×6 ft), to a maximum spacing of 16 ft.×16 ft. Accordingly, each of the nozzles 18 define a preferred coverage area per nozzle that ranges from a minimum of 36 square feet per nozzle to a maximum of 256 square feet (sq. ft.) per nozzle. For the systems described throughout herein, the maximum wall to nozzle (or where applicable sprinkler) spacing is preferably one half the maximum nozzle-to-nozzle spacing. For the preferred system 10 using a preferred nozzle 18 having a K-factor of less than 1 gpm/psi$^{1/2}$ and preferably 0.81 gpm/psi$^{1/2}$ and an operating pressure in the range from a minimum of about 140 psi. to a maximum of about 250 psi, the water demand for the preferred system is defined by the greater of the most remote five nozzles or a hydraulic design area of 900 sq. ft. area. In the preferred system installation, preferred obstruction criteria provides that the maximum vertical distance between a vertical obstruction and the diffusing element of the preferred nozzle 18 is fifteen inches (15 in.) at a maximum horizontal distance from the nozzle axis of about seventy-two inches (72 in.). A preferred nozzle 18 for use in the system is shown in FIGS. 2-10 and described in detail below and in U.S. Provisional Application No. 61/193,874 filed on Jan. 2, 2009.

Another embodiment of the system 10' is based upon an alternative set of design criteria to provide mist type fire protection for a light hazard and ordinary hazard occupancy having a maximum ceiling height of about seventeen feet and more particularly 16 ft.-5 in. The design criteria more specifically provides that the nozzles are disposed beneath the ceiling at a nozzle-to-nozzle spacing that ranges from a minimum six feet-by-six feet (6 ft.×6 ft), to a maximum spacing of about 12 ft.×12 ft. Accordingly, each of the nozzles define a preferred coverage area per nozzle that ranges from a minimum of 36 sq. feet per nozzle to a maximum of about 144 sq. ft per nozzle. Using another preferred nozzle 18' having a K-factor of preferably less than 1 gpm/psi$^{1/2}$, and more preferably about 0.6 gpm/psi$^{1/2}$ and even more preferably 0.59 gpm/psi$^{1/2}$ and an operating pressure in the range from a minimum of about 110 psi. to a maximum pressure of about 250 psi., the water demand for the preferred system preferably varies with the ceiling height. Accordingly, the water demand of the system 10' is preferably defined by the following criteria: (i) the greater of the most remote five nozzles or a hydraulic design area of 900 sq. ft. area for a maximum ceiling height of about ten feet and more particularly 9 ft.-10 in.; (ii) the greater of the most remote five nozzles or a hydraulic design area of 975 sq. ft. area for a maximum ceiling height of about thirteen feet and more particularly 13 ft.-1 in.; and (iii) the greater of the most remote five nozzles or a hydraulic design area of 1044 sq. ft. for a maximum ceiling height of about seventeen feet and more particularly 16 ft.-5 in. For ceiling heights between about ten feet and seventeen feet, the water demand can be defined by interpolation of the aforementioned criteria. In the preferred system installation, preferred obstruction criteria provides that the maximum vertical distance between a vertical obstruction and the diffusing element of the preferred nozzle 18' is fifteen inches (15 in.) at a maximum horizontal distance from the nozzle axis of about sixty-six inches (66 in.). The preferred nozzle 18' for use in the system 10' is shown in FIGS. 11-18 and described below and in U.S. Provisional Application No. 61/193,875, filed on Jan. 2, 2009.

In view of the above design criteria, the preferred systems using nozzles 18, 18' which operate at a low to intermediate pressure (175 psi.<x<500 psi.), preferably low pressure (<175 psi) to provide mist-type fire protection for a coverage area per nozzle that is greater than 132 sq. ft. per nozzle, preferably up to 144 sq. ft. per nozzle and more preferably a maximum 256 sq. ft. per nozzle. As mist generating devices, the nozzles 18, 18' provide an effective density of less than 0.1 gpm/sq. ft., preferably less than 0.05 gpm/sq. ft., and more preferably a density of between about 0.05 gpm/sq. ft. and 0.03 gpm/sq. ft.

In another embodiment of the preferred system 10", the design criteria of the system can provide for light and ordinary hazard occupancy protection in which the occupancy has a compartmented protection area exceeding 1024 square feet. Additionally, the preferred system 10" provides for protection for light and ordinary hazard occupancies beneath ceilings having a maximum ceiling height of up to about 13 feet and more particularly 13 ft.-1 in. The preferred system 10" incorporates a network of known nozzles 20, such as for example, the AM24 AquaMist®, from Tyco. The known nozzles are shown and described in a draft data sheet entitled, TFP2224: AquaMist Nozzle® Type AM24 Automatic (Closed) (Draft Sep. 22, 2008), which is attached in U.S. Provisional Application No. 61/193,873, filed Jan. 2, 2009. An earlier version of the Type AM24 data sheet, dated November 1997, is also attached to U.S. Provisional Application No. 61/193,873. For the system 10" using the preferred Tyco AM24 as the know nozzle 20, the devices have a K-factor of 0.64 gpm/psi$^{1/2}$ and a minimum operating pressure of about 100 psi and preferably 102 psi.

According to the preferred design criteria of the system 10", the preferred known nozzles 20" are used to protect preferably about thirty percent (30%) of the entire compartmented protection area and preferably no more than about 30%. However, the percent coverage by the known nozzles may vary provides the combination of nozzle components, provide effective protections to the occupancy. The remaining area is preferably protected by one of the preferred nozzles 18, 18' as previously described in accordance with their installation and performance requirements. The design criteria for the system 10" and the installation of the preferred known nozzles 20" is preferably a function of the type of ordinary hazard being protected, the height of any storage that is present and the height of the ceiling of the occupancy being protected. More specifically, the nozzles are preferably installed with a nozzle-to-nozzle spacing that ranges from a minimum six feet-by-six feet (6 ft.×6 ft), to a maximum spacing of about 12 ft.×12 ft based upon the group of ordinary hazard being protected, the maximum ceiling height of the occupancy and the presence of any storage. Accordingly, each of the nozzles 20 define a coverage area per nozzle that ranges from a minimum of 36 square feet per nozzle to a maximum of about 144 sq. ft per nozzle. The water demand for the alternate preferred system 10" is preferably defined by the greater of the most remote five nozzles or a hydraulic design area of 900 sq. ft. area.

The preferred nozzle-to-nozzle spacing for the known devices 20 is preferably defined by the following preferred criteria in the absence of any storage: (i) for a Group 1 ordinary hazard occupancy (NFPA) beneath a ceiling height of about ten feet and more particularly 9 ft-10 in, the nozzle to nozzle spacing preferably ranges from a minimum of 6 ft.×6 ft to a maximum of about 12 ft.×12 ft. and more particularly about 11 ft-5 in.×11 ft.-5 in.; (ii) for a Group 1 ordinary hazard occupancy (NFPA) beneath a ceiling height of about thirteen feet and more particularly 13 ft-1 in, the nozzle to nozzle spacing preferably ranges from a minimum of 6 ft.×6 ft to a maximum of about 10 ft.×10 ft. and more particularly 9 ft.-10 in×9 ft.-10 in.; and (iii) for a Group 2 ordinary hazard occupancy (NFPA) beneath a ceiling height of about ten feet and more particularly 9 ft-10 in, the nozzle to nozzle spacing preferably ranges from a minimum of 6 ft.×6 ft to a maximum of about 10 ft.×10 ft. and more particularly 9 ft.-10 in×9 ft.-10 in.; or (iv) for a Group 2 ordinary hazard occupancy (NFPA) beneath a ceiling height of about thirteen feet and more particularly 13 ft-1 in, the nozzle to nozzle spacing preferably ranges from a minimum of 6 ft.×6 ft to a maximum of about 8 ft.×8 ft. and more particularly 8 ft.-2 in×8 ft.-2 in.

The preferred system 10" further includes alternate design criteria for where the occupancy may include ordinary hazard storage. In such an instance the design criteria preferably provides nozzle-to-nozzle spacing for the known devices 20 in the presence of storage as follows: (i) for a Group 1 ordinary hazard occupancy (NFPA) beneath a ceiling height of about ten feet and more particularly 9 ft-10 in with storage at a maximum height of about 8 feet so as to provide a clearance of about two feet, the nozzle to nozzle spacing preferably ranges from a minimum of 6 ft.×6 ft to a maximum of about 8 ft.×8 ft. and more particularly about 8 ft-2 in.×8 ft.-2 in.; or (ii) for a Group 2 ordinary hazard occupancy (NFPA) beneath a ceiling height of about eight feet and more particularly 8 ft-2 in with storage at a maximum height of about five feet (4 ft.-11 in.) so as to provide a clearance of about three feet, the nozzle to nozzle spacing preferably ranges from a minimum of 6 ft.×6 ft to a maximum of about 8 ft.×8 ft. and more particularly about 8 ft-2 in.×8 ft.-2 in.

In yet another alternate embodiment of the preferred system 10''' the design criteria provides for light and ordinary hazard occupancy protection in which the occupancy has a compartmented protection area exceeding 1024 square feet. Additionally, the preferred system provides for protection for light and ordinary hazard occupancies beneath ceilings having a maximum ceiling heights which may exceed twenty feet. The preferred system 10''' incorporates a network of known automatic pendent sprinklers 22, such as for example, the Series TY-FRB Sprinkler from Tyco. The known pendent sprinklers are shown and described in the technical data sheet is entitled, TFP670*: Series TY-B & TY-FRB* 10 *mm Orifice Upright & Pendent Sprinklers w/ISO* 7/1-*R*3/8 *Threads Standard & Quick Response* (July 2004) which is attached in U.S. Provisional Application No. 61/193,873, filed Jan. 2, 2009. The automatic sprinklers are preferably selected and installed in accordance with NFPA 13. For the system 10" using the preferred Tyco AM24 as the known nozzle 20, the devices have a K-factor of about 4 gpm/psi$^{1/2}$, preferably 57 lpm/bar$^{1/2}$, and a maximum operating pressure of 175 psi.

According to the preferred design criteria for the system 10''', the preferred sprinklers are used to protect preferably about 30% and preferably no more than thirty percent (30%) of the entire compartmented protection area. The remaining area is preferably protected by one of the preferred nozzles 18, 18' as previously described in accordance with their installation and performance requirements. The design criteria more specifically provides that the sprinklers 22 are disposed beneath the ceiling at a sprinkler-to-sprinkler spacing that ranges from a minimum six feet-by-six feet (6 ft.×6 ft), to a maximum spacing of about 12 ft.×12 ft. and more preferably to a maximum of about 15 ft.×15 ft. Accordingly, each of the sprinklers define a preferred coverage area per sprinkler that ranges from a minimum of 36 square feet per sprinkler to a maximum of about 130 sq. ft per sprinkler and more preferably a maximum of about 225 sq. ft per sprinkler.

The water demand for the preferred system 10''' preferably varies with the ceiling height of the occupancy. Accordingly, the water demand of the system 10''' is preferably defined by the following criteria:: (i) for ceiling heights up to and including ten feet (10 ft.) the greater of the most remote five sprinklers or a 900 sq. ft. hydraulic design area; (ii) for ceiling heights up to and including fifteen feet (15 ft.) the greater of the most remote five sprinklers or a 1013 sq. ft. area; (iii) for ceiling heights up to and including twenty feet (20 ft.) the greater of the most remote five sprinklers or a 1125 sq. ft. area; and (iv) for ceiling heights greater than twenty feet (20 ft.) the greater of the most remote five sprinklers or a 1500 sq. ft. area. For ceiling heights between about ten feet and twenty feet, the water demand can be defined by interpolation of the aforementioned criteria.

Summarized below in Table 1 are the preferred design criteria for each of the systems 10, 10', 10", 10''' described above. For any given light and ordinary hazard occupancy the design criteria can be combined to provide a desired mist type fire protection in which generally low to intermediate pressure (175 psi.<x<500 psi.) and preferably low pressure (<175 psi) devices area used to having coverage area per nozzle that is greater than 132 sq. ft. per device, preferably up to 144 sq. ft. per device and more preferably a maximum 256 sq. ft. per device. Structural and installation features of the above-described systems are also described in draft data sheet TFP2231: AquaMist System (Performance Based Design) Using Type AM27 & AM29 AquaMist Nozzles For Protection of Light & Ordinary Hazard Occupancies (Draft Dec. 30, 2008) ("TFP2231") which is attached to U.S. Provisional Patent Application No. 61/193,873, filed Jan. 2, 2009. Accordingly, listed in the table below are preferred fluid distribution devices types for the various system design criteria: (i) the nozzle of FIGS. 2-10 which is to be commercialized as the AM27 AquaMist Nozzle described below; (ii) the nozzle of FIGS. 11-18 which is to be commercialized as the AM29 AquaMist Nozzle described below; (iii) the known nozzle of AM24 AquaMist Nozzle noted above; and (iv) the known frangible sprinklers TY-FRB sprinklers as noted above. The table provides preferred numerical values of K-factor, operating pressure, device spacing and water demand. As preferred numerical values, it should be understood that variability of the preferred varied value is encompassed in the preferred embodiment as long as the resultant effective density is sufficient to provide the desired mist-type fire protection.

TABLE 1

| Occupancy (L—light; OH—ordinary hazard; OH1—OH Group 1; OH2—OH Group 2) | Max Protection Area For Device Type Area - Sq. Ft. (Sq. m.) | Max Ceiling Height - ft. (m.) | Device Type | K-Factor-gpm/psi$^{1/2}$ | Min. Op. Pressure (psi.) |
|---|---|---|---|---|---|
| L & OH | 1024 (Compartmented) | 9'-10" (3)` | Nozzle (preferred AM27) | 0.81 | 102 |
| L & OH | Unlimited | 9'-10" (3) | Nozzle (preferred AM29) | 0.59 | 110 |

TABLE 1-continued

| | | | | | |
|---|---|---|---|---|---|
| L & OH | Unlimited | 13'-1" (4) | Nozzle (preferred AM29) | 0.59 | 110 |
| L & OH | Unlimited | 16'-5" (5) | Nozzle (preferred AM29) | 0.59 | 110 |
| OH1 (without storage) | No more than 30% Total Protection Area | 9'-10" (3) | Nozzle (preferred AM24) | 0.64 | 102 |
| OH1 (without storage) | No more than 30% Total Protection Area | 13'-1" (4) | Nozzle (preferred AM24) | 0.64 | 102 |
| OH1 (with max 8'. (2.4 m) storage; Clearance 2') | No more than 30% Total Protection Area | 9'-10" (3) | Nozzle (preferred AM24) | 0.64 | 102 |
| OH2 (without storage) | No more than 30% Total Protection Area | 9'-10" (3) | Nozzle (preferred AM24) | 0.64 | 102 |
| OH2 (without storage) | No more than 30% Total Protection | 13'-1" (4) | Nozzle (preferred AM24) | 0.64 | 102 |
| OH2 (with max 4'-11"(1.5 m) storage; Clearance 3'-2") | No more than 30% Total Protection Area | 9'-10" (3) | Nozzle (preferred AM24) | 0.64 | 102 |
| L & OH1 | No more than 30% Total Protection Area | 10' (3.1) | Sprinkler (Preferred frangible bulb) | 57 (LPM/bar$^{1/2}$); Nom. 4 gpm/psi.$^{1/2}$ | 175 psi. (Maximum) |
| L & OH1 | No more than 30% Total Protection Area | 15' (4.6) | Sprinkler (Preferred frangible bulb) | 57 (LPM/bar$^{1/2}$); Nom. 4 gpm/psi.$^{1/2}$ | 175 psi. (Maximum) |
| L & OH1 | No more than 30% Total Protection Area | 20' (6.1) | Sprinkler (Preferred frangible bulb) | 57 (LPM/bar$^{1/2}$); Nom. 4 gpm/psi.$^{1/2}$ | 175 psi. (Maximum) |
| L & OH1 | No more than 30% Total Protection Area | Greater than 20' (6.1) | Sprinkler (Preferred frangible bulb) | 57 (LPM/bar$^{1/2}$); Nom. 4 gpm/psi.$^{1/2}$ | 175 psi. (Maximum) |
| L & OH2 | No more than 30% Total Protection Area | 10' (3.1) | Sprinkler (Preferred frangible bulb) | 57 (LPM/bar$^{1/2}$); Nom. 4 gpm/psi.$^{1/2}$ | 175 psi. (Maximum) |
| L & OH2 | No more than 30% Total Protection Area | 15' (4.6) | Sprinkler (Preferred frangible bulb) | 57 (LPM/bar$^{1/2}$); Nom. 4 gpm/psi.$^{1/2}$ | 175 psi. (Maximum) |
| L & OH2 | No more than 30% Total Protection Area | 20' (6.1) | Sprinkler (Preferred frangible bulb) | 57 (LPM/bar$^{1/2}$); Nom. 4 gpm/psi.$^{1/2}$ | 175 psi. (Maximum) |
| L & OH2 | No more than 30% Total Protection Area | Greater than 20' (6.1) | Sprinkler (Preferred frangible bulb) | 57 (LPM/bar$^{1/2}$); Nom. 4 gpm/psi.$^{1/2}$ | 175 psi. (Maximum) |

| Occupancy (L—light; OH—ordinary hazard; OH1—OH Group 1; OH2—OH Group 2) | Effective Flux Density - gpm/sq. ft. | Min. Spacing - ft. × ft. (m. × m.) | Max. Spacing - ft. × ft. (m. × m.) | Water Demand |
|---|---|---|---|---|
| L & OH | 0.037 | 6 × 6 (1.8 × 1.8) | 16 × 16 (4.9 ×. 4.9) | Greater of 5 remote nozzles OR 900 sq. ft (84 sq. m) |
| L & OH | 0.043 | 6 × 6 (1.8 × 1.8) | 12 × 12 (3.7 × 3.7) | Greater of 5 remote nozzles OR 900 sq. ft (84 sq. m) |
| L & OH | 0.043 | 6 × 6 (1.8 × 1.8) | 12 × 12 (3.7 × 3.7) | Greater of 5 remote nozzles OR 975 sq. ft (91 sq. m) |
| L & OH | 0.043 | 6 × 6 (1.8 × 1.8) | 12 × 12 (3.7 × 3.7) | Greater of 5 remote nozzles OR 1044 sq. ft (97 sq. m) |

TABLE 1-continued

| | | | | |
|---|---|---|---|---|
| OH1 (without storage) | 0.096 | 6 × 6 (1.8 × 1.8) | 11'-5" × 11'-5" (3.5 × 3.5) | Greater of 5 remote nozzles OR 900 sq. ft (84 sq. m) |
| OH1 (without storage) | 0.096 | 6 × 6 (1.8 × 1.8) | 9'-10" × 9'-10" (3 × 3) | Greater of 5 remote nozzles OR 900 sq. ft (84 sq. m) |
| OH1 (with max 8'. (2.4 m) storage; Clearance 2') | 0.096 | 6 × 6 (1.8 × 1.8) | 8'-2" × 8'-2" (2.5 × 2.5) | Greater of 5 remote nozzles OR 900 sq. ft (84 sq. m) |
| OH2 (without storage) | 0.096 | 6 × 6 (1.8 × 1.8) | 9'-10" × 9'-10" (3 × 3) | Greater of 5 remote nozzles OR 900 sq. ft (84 sq. m) |
| OH2 (without storage) | 0.096 | 6 × 6 (1.8 × 1.8) | 8'-2" × 8'-2" (2.5 × 2.5) | Greater of 5 remote nozzles OR 900 sq. ft (84 sq. m) |
| OH2 (with max 4'-11"(1.5 m) storage; Clearance 3'-2") | 0.096 | 6 × 6 (1.8 × 1.8) | 8'-2" × 8'-2" (2.5 × 2.5) | Greater of 5 remote nozzles OR 900 sq. ft (84 sq. m) |
| L & OH1 | | 6 × 6 (1.8 × 1.8) | 15' × 15' (2.3 × 2.3) | Greater of 5 remote sprinklers OR 900 sq. ft (84 sq. m) |
| L & OH1 | | 6 × 6 (1.8 × 1.8) | 15' × 15' (2.3 × 2.3) | Greater of 5 remote sprinklers OR 1013 sq. ft (94 sq. m) |
| L & OH1 | | 6 × 6 (1.8 × 1.8) | 15' × 15' (2.3 × 2.3) | Greater of 5 remote sprinklers OR 1125 sq. ft (105 sq. m) |
| L & OH1 | | 6 × 6 (1.8 × 1.8) | 15' × 15' (2.3 × 2.3) | Greater of 5 remote sprinklers OR 1500 sq. ft (139 sq. m) |
| L & OH2 | | 6 × 6 (1.8 × 1.8) | 11'-5" × 11'-5" (3.5 × 3.5) | Greater of 5 remote sprinklers OR 900 sq. ft (84 sq. m) |
| L & OH2 | | 6 × 6 (1.8 × 1.8) | 11'-5" × 11'-5" (3.5 × 3.5) | Greater of 5 remote sprinklers OR 900 sq. ft (84 sq. m) |
| L & OH2 | | 6 × 6 (1.8 × 1.8) | 11'-5" × 11'-5" (3.5 × 3.5) | Greater of 5 remote sprinklers OR 900 sq. ft (84 sq. m) |
| L & OH2 | | 6 × 6 (1.8 × 1.8) | 11'-5" × 11'-5" (3.5 × 3.5) | Greater of 5 remote sprinklers OR 900 sq. ft (84 sq. m) |

In another alternate embodiment of the system 10"", preferred design criteria provides mist type fire protection for a light hazard only occupancy having a maximum compartmented protection area of 1024 square ft (sq. ft.) beneath a ceiling having a maximum ceiling height of about eight feet (8 ft.). The design criteria more specifically provides that the nozzles 18 shown in FIGS. 2-10, are disposed beneath the ceiling at a nozzle-to-nozzle spacing that ranges from a minimum six feet-by-six feet (6 ft.×6 ft), to a maximum spacing of 16 ft.×16 ft. Accordingly, each of the nozzles 18 define a preferred coverage area per nozzle that ranges from a minimum of 36 square feet per nozzle to a maximum of 256 sq. ft. per nozzle. The water demand for the preferred system is preferably defined by providing a sixty minute duration of water to each of the nozzles 18 in the system at the operating pressure which can range from 140 psi to 250 psi.

In yet another embodiment of the system 10"", preferred design criteria provides mist type fire protection for a light hazard only occupancy beneath a ceiling having a maximum ceiling height of about seventeen feet and more particularly 16 ft-5 in. The design criteria more specifically provides that the nozzles 18' shown in FIGS. 11-18, are disposed beneath the ceiling at a nozzle-to-nozzle spacing that ranges from a minimum six feet-by-six feet (6 ft.×6 ft), to a maximum spacing of 12 ft.×12 ft. Accordingly, each of the nozzles 18 define a preferred coverage area per nozzle that ranges from a minimum of 36 square feet per nozzle to a maximum of 144 sq. ft. per nozzle. The water demand for the preferred system is preferably defined by providing a sixty minute duration of water at an operating pressure in the range of about 110 psi to 250 psi to a 1500 sq. ft. hydraulic demand area, or for protection of areas less than 1500 sq. ft, providing the sixty minute water supply to each of the nozzles 18' in the in the protected area.

Summarized below in Table 2 are the preferred design criteria for each of the light hazard only systems described above. The preferred systems are also described in the draft data sheet is entitled, TFP2230*: AquaMist System* (*FM*) *Using Type AM*27 *and AM*29 *AquaMist Nozzles For Protection of Light Hazard Occupancies* (Draft Dec. 30, 2008) which is attached to U.S. Provisional Patent Application No. 61/193,873, filed Jan. 2, 2009. Accordingly, listed in the table below are preferred fluid distribution devices types for the various system design criteria: (i) the nozzle of FIGS. 2-10 which is to be commercialized as the AM27 AquaMist Nozzle described below; and (ii) the nozzle of FIGS. 11-18 which is to be commercialized as the AM29 AquaMist Nozzle described below. The table provides preferred numerical values of K-factor, operating pressure, device spacing and water demand. As preferred numerical values, it should be understood that the variability of the preferred varied value is encompassed in the preferred embodiment as long as the resultant effective density is sufficient to provide the desired mist-type fire protection.

TABLE 2

| Occupancy (L—light hazard) | Max Protection Area For Device Type Area - Sq. Ft. (Sq. m.) | Max Ceiling Height - ft. (m.) | Device Type | K-Factor-gpm/psi$^{1/2}$ | Min. Op. Pressure (psi.) | Effective Flux Density - gpm/sq. ft. | Min. Spacing - ft. × ft. (m. × m.) | Max. Spacing - ft. × ft. (m. × m.) | Water Demand |
|---|---|---|---|---|---|---|---|---|---|
| L | 1024 (Compartmented) | 8 (2.4) | Nozzle (preferred AM27) | 0.81 | 140 | 0.037 | 6 × 6 (1.8 × 1.8) | 16 × 16 (4.9 ×. 4.9) | 60 minutes to all nozzles |
| L | Unlimited | 16'-5" (5) | Nozzle (preferred AM29) | 0.59 | 110 | 0.043 | 6 × 6 (1.8 × 1.8) | 12 × 12 (3.7 × 3.7) | 60 minutes to all nozzles for protection area under 1500 sq. feet; or a maximum of 1500 sq. ft for protection area of 1500 sq. ft. or more |

The systems above incorporate preferred mist devices for the protection of at least one of a light hazard occupancy only and a light and ordinary hazard occupancy having a ceiling with a maximum ceiling height of at least 8 ft. The preferred devices include a body defining an internal passage having an inlet and an outlet for the discharge of a fluid. For the preferred devices, an orifice insert disposed within the passageway defines a K-factor of less than 1 gpm/psi$^{1/2}$. A pair of frame arms extend between the upper and lower body portion and centered about the device axis, and a seal assembly is disposed in the outlet including a thermally sensitive element to support the seal assembly. The preferred device includes means for diffusing the fluid at a flux density of less than 0.1 gpm/sq. ft. for a fluid pressure at the inlet of less than 500 psi$^{1/2}$. to define a coverage area of the device of over than 132 sq. ft., preferably to a maximum of 256 sq. ft.

Show in FIG. 2 is the preferred nozzle 18 embodied as automatically operating nozzle 100 that includes a frame 112 having an upper body element 113 with external threads 114 for coupling the frame 112 to a fire fighting fluid supply system such as for example, a branch line of a water supply pipe. Alternatively, the body 113 can be configured for other type connections to the fluid supply, for example, the frame 112 can include a groove, for a groove type coupling connection to the fluid supply. Disposed within upper body element 113 is a strainer 115. The strainer 115 includes a plurality of openings 116 to allow passage of fire fighting fluid while filtering out debris which may clog or damage the internal passageway of the nozzle 100.

Depending from and preferably symmetrically about the body 113 are a pair of frame arms 118, 120. The arms 118, 120 extend axially and preferably converge about a lower body element 122 located distally of the upper body element 113. Preferably, the arms 118, 120 are formed integrally with the upper and lower body elements 113, 122. The frame 112 is preferably machined from a cast body of, for example, brass, in which the upper body element 113, arms 118, 120 and lower body element 122 are integrally formed. The upper and lower body elements 113, 122 are preferably coaxially spaced from one another along the nozzle axis III-III. The lower body element 122 is preferably elliptical to frustroconical in shape having a proximal portion that converges in the direction of the upper body element 113 toward the axis III-III.

Referring to the cross-sectional view of the nozzle 100 in FIG. 3, the upper body element 113 has an inlet 124 and an axially spaced outlet 126 to define therebetween an axially extending passageway 128 through which the fire fighting fluid can pass. When the nozzle 100 is in the closed and unactuated condition, disposed within the outlet 126 is a seal assembly to seal the passageway and prevent the flow of fluid from the passageway 128. The seal assembly preferably includes a button 130 having a spring seal 132 disposed about it. The spring seal 132 engages a surface of the outlet 126 to form a fluid tight seal and prevent liquid flowing out of the passageway 128 and discharging from the outlet 126.

A thermally sensitive element 134 is engaged with seal assembly to maintain the seal assembly within the outlet 126 to prevent the flow of fluid from the passageway 128. Preferably the thermally sensitive element 134 is a bulb 134 that is thermally rated to rupture in response to a threshold temperature of a fire. The bulb 134 provides for automatic actuation of the nozzle 100 in response to a sufficient level of heat by rupturing in response to the fire so as to disengage the button 130 and allow for the release of fire fighting fluid from the passageway 128. The bulb 134 is preferably configured with a Response Time Index (RTI) of 50 (meters-seconds)$^{1/2}$ or less, and is more preferably about 36 (meters-seconds)$^{1/2}$ so as to have a fast response, and more preferably, the bulb 134 is such that the nozzle 100 can be listed as a quick response device by the appropriate listing agency. A load screw diffuser assembly 136 is preferably provided to support the bulb 134 in its engagement with the button 130 to maintain the nozzle in its unactuated configuration. The load screw diffuser assembly 136 is preferably threaded and engaged within a bore 138 of the lower body element 22 of the frame 112.

Referring back to FIG. 2, an ejection spring 140 imposes a lateral force on the seal assembly such that when the release element 134 bursts at a predetermined temperature due to exposure to the abnormally high temperatures caused by a fire, the button 130 and spring seal 132 are thrown to the side from their normal or standby sealing position, thereby to allow fluid to discharge through the passageway 128 and impinge upon a diffuser element 200, secured to the loading screw assembly 136 to form the desired fluid mist spray pattern.

FIG. 3 shows disposed within passageway 128, just distal of the inlet 124, an orifice insert 150. The orifice insert 150 is preferably configured with an outer geometry that is substantially cylindrical in shape and dimensioned for a close slip fit within the passageway 128 of the upper body element 113. Preferably, the insert 150 defines an overall diameter of about 0.6 inches. The insert 150 is preferably located and supported in the passageway by a shelf 129 formed or machined in the inner surface of the upper body element 113 that defines the passageway 128. The orifice insert 150 has a through bore 152 that is configured to control the inlet and flow of the fire fighting fluid entering the nozzle 100 at the inlet 124.

Figure 10:
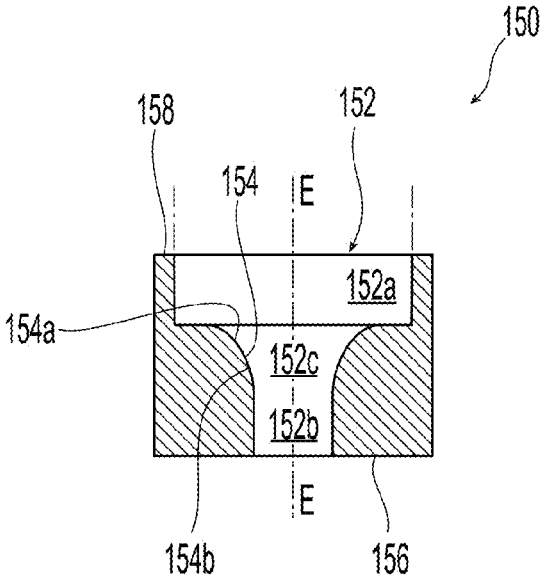
FIG. 10 is a cross-sectional detailed view of the orifice insert used in the nozzle of FIGS. 2 and 3.

Shown in FIG. 10 is a detailed view of the orifice insert 150. The through bore 152 defines a preferred profile in which the cross-sectional area of the through bore 152 orthogonal to the insert axis narrows from the upper portion 152*a* to the lower portion 152*b* of the through bore 152 to define the flow characteristics of the fluid entering the upper portion 152*a* and existing the lower portion 152*b*. The upper through bore portion 152*a* preferably defines a substantially cylindrical volume to house a portion of the strainer 115, and the lower through bore portion 152*b* preferably defines a narrower cylindrical volume to define the outlet orifice of the insert 150. Transitioning between the upper and lower portions 152*a*, 152*b* of the through bore 152 is an intermediate portion 152*c* of the through bore that is substantially frustroconical.

Preferably, the upper cylindrical portion 152*a* of the through bore 152 has a diameter of about 0.5 inches. The axial depth of the upper cylindrical portion 152*a* ranges between about 0.1 inches to about 0.2 inches. The lower cylindrical portion 152*b* of the through bore 152 has a diameter of preferably ranging from about 0.16 inch to about 0.18 inch and more preferably ranging from about 0.1675 inch to about 0.1705 inch so as to define a K-factor of the orifice to be less than 1 gpm/$(psi)^{1/2}$ more preferably ranging from of about 0.7 to about 0.9 gpm/$(psi)^{1/2}$ and is more preferably 0.81 gpm/$(psi)^{1/2}$.

The substantially frustroconical intermediate portion 152*c* of the through bore 152 is preferably defined by an interior surface defining an inwardly convex, curvilinear shape for the transition surface 154 between the upper portion 152*a* and the lower portion 152*b*. For conditions in which the inlet fluid supply pressure to the nozzle is up to more than 250 psi, the transition surface 154 can facilitate a stable discharge of fluid flow from the outlet orifice of the lower through bore portion 152*b* to impact the diffuser element 200 without any significant alteration of the water spray pattern.

In the cross-sectional view of the orifice inlet of FIG. 10, the transition surface preferably defines an arc that can be approximated by one quarter of an ellipse having a major axis length of about 0.326 inches and a minor axis length of about 0.218. It has also been found that combinations of two or more radii can be used to approximate the shape of the preferred ellipse profile and therefore approximate the transition surface 154, as long as all radius transition points are smoothly blended. For example, in one preferred embodiment, the elliptical profile can be defined by a first arc 154*a*, and second arc 14*b*, in which the first arc 154*a* initiates axially at a distance of 0.279 inches from the top surface 158 of the orifice insert 150 and radially continuous with the interior surface of the lower portion 152*b* of the through bore at a preferred distance of 0.08 inches from the insert axis E-E. The first arc 154*a* terminates axially at 0.187 inches from the top surface 158, radially at 0.118 inches from the insert axis EE with a radius of curvature of 0.227 inches. The second arc initiates 0.187 inches from the top surface 158 of the orifice insert 150 so as to define a continuous smooth transition with the first arc 154*a*. Moreover the second arc terminates at an axial distance of 0.146 from the top surface 158 and at a radial distance of about 0.191 inches from the axis B-B of the insert, with a radius of curvature of about 0.08 inches.

It has been determined that the profile of the orifice outlet of the lower through bore portion 152*b* of the orifice insert 150 can also affect the stability of the fluid stream discharged from the orifice insert 150 before it impacts the diffuser element 200 of the load screw assembly 236. Preferably, bottom surface 156 of the orifice insert defines a planar orthogonal surface relative to the axis EE of the orifice insert 150 such that the exit orifice of the lower portion 152*b* of the through bore is defined by a right angle transition between the interior of the lower portion 152*b* of the through bore and the bottom surface 156 of the orifice insert.

Figure 4:
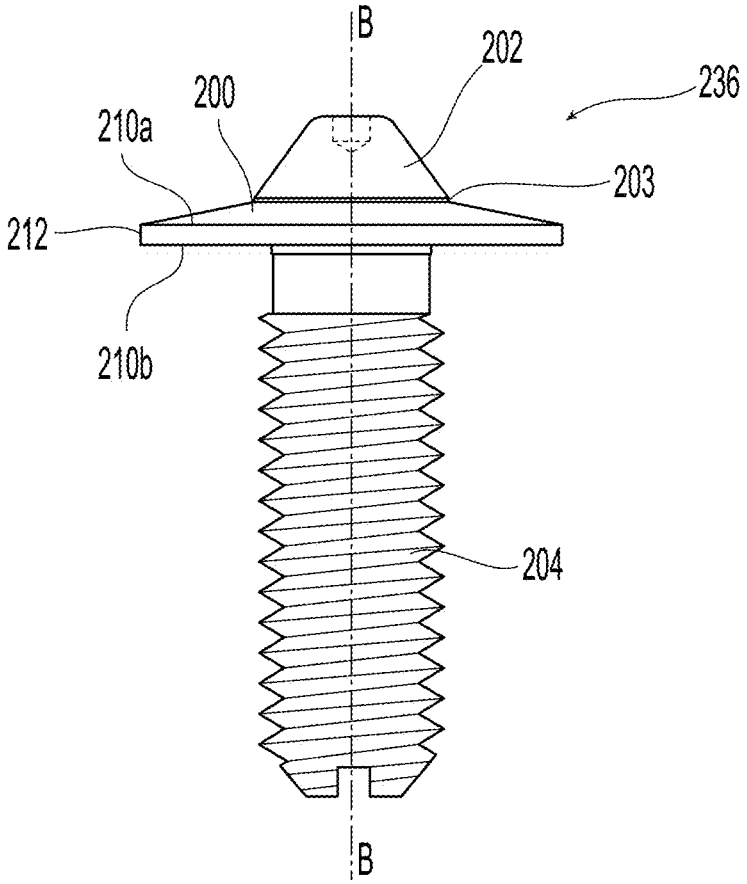
FIG. 4 is a detailed view of the load screw diffuser assembly used in the nozzle of FIG. 2.

Shown in FIG. 4 is a detailed view of the preferred load screw diffuser assembly 236 with the preferred diffuser element 200, a cone 202 and preferred load screw shank 204 coaxially aligned along the assembly axis B-B. The diffuser element 200, cone 202, and load screw shank 204 are preferably constructed as a single piece construction to form the load screw diffuser assembly 236. Alternatively, the load screw assembly 236 can be formed of discrete components that are joined together by methods such as, for example, welding, threaded, or press fit techniques. The cone 202 is preferably truncated at its proximal end and at the base of the cone 202 the distal end includes a vertical transition 203 that extends parallel to the axis B-B to the upper surface 210*a* of the diffuser element 200.

Figure 7:
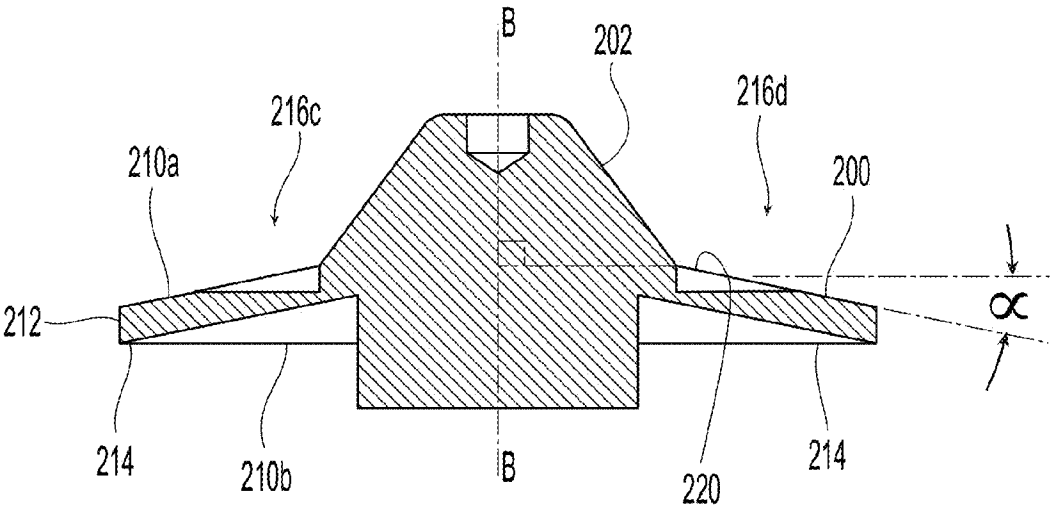
FIG. 7 is another cut-away view of the load screw of FIG. 3.
Figure 8:
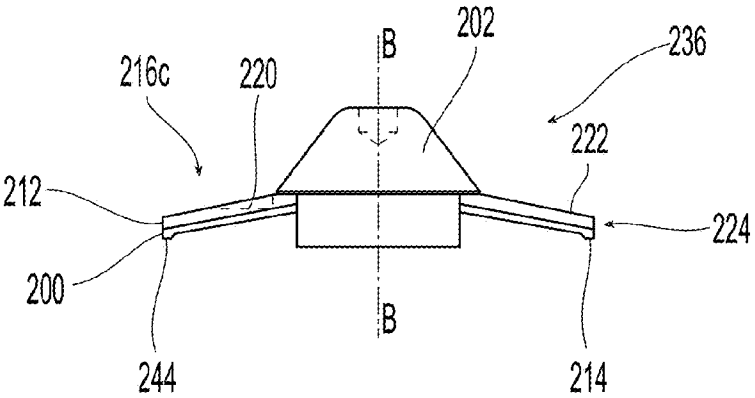
FIG. 8 is a detailed view of the diffuser element and cone of the load screw assembly of FIG. 4.

Referring to FIG. 4, the diffuser element 200 is preferably a substantially annular element and is more preferably a frustroconical element having an upper diffuser surface 210*a*, a lower diffuser surface 210*b*, and a peripheral surface 212 to define the outer edge and maximum diameter of the diffuser element 200. The diffuser element 200 has a preferred maximum diameter of about 0.5 inches. Referring to FIGS. 7 and 8, the upper and lower diffuser surfaces 210*a*, 210*b* are preferably parallel to one another. The surfaces are angled relative to the diffuser axis B-B so as to define an included angle $\alpha$ relative to a plane orthogonal to the diffuser axis B-B ranging between about 10 degrees to about 12 degrees and is more preferably about 11 degrees. Moreover, the upper and lower diffuser surfaces 210*a*, 210*b* are preferably spaced apart to define a thickness of the diffuser 200 ranging between about 0.02 inch to about 0.03 inch. The lower diffuser surface 210*b* preferably extends parallel to the upper diffuser surface 210*a* parallel over a radial distance of about 0.23 inches and then transitions radially and axially to define the maximum thickness of the diffuser at a preferred radial distance of about 0.24 inches. The diffuser element 200 is preferably thicker at the outer edge such that the peripheral surface 212 defines an axial thickness of about 0.030 inch. The lower diffuser surface 210*b* then preferably extends radially perpendicular to the diffuser axis B-B toward the maximum diameter of the diffuser 200 to terminate at the peripheral surface 212 so as to define an annular lip 214 or skirt. The annular lip 214 has a preferred radial thickness of about 0.02 inches.

Figure 9:
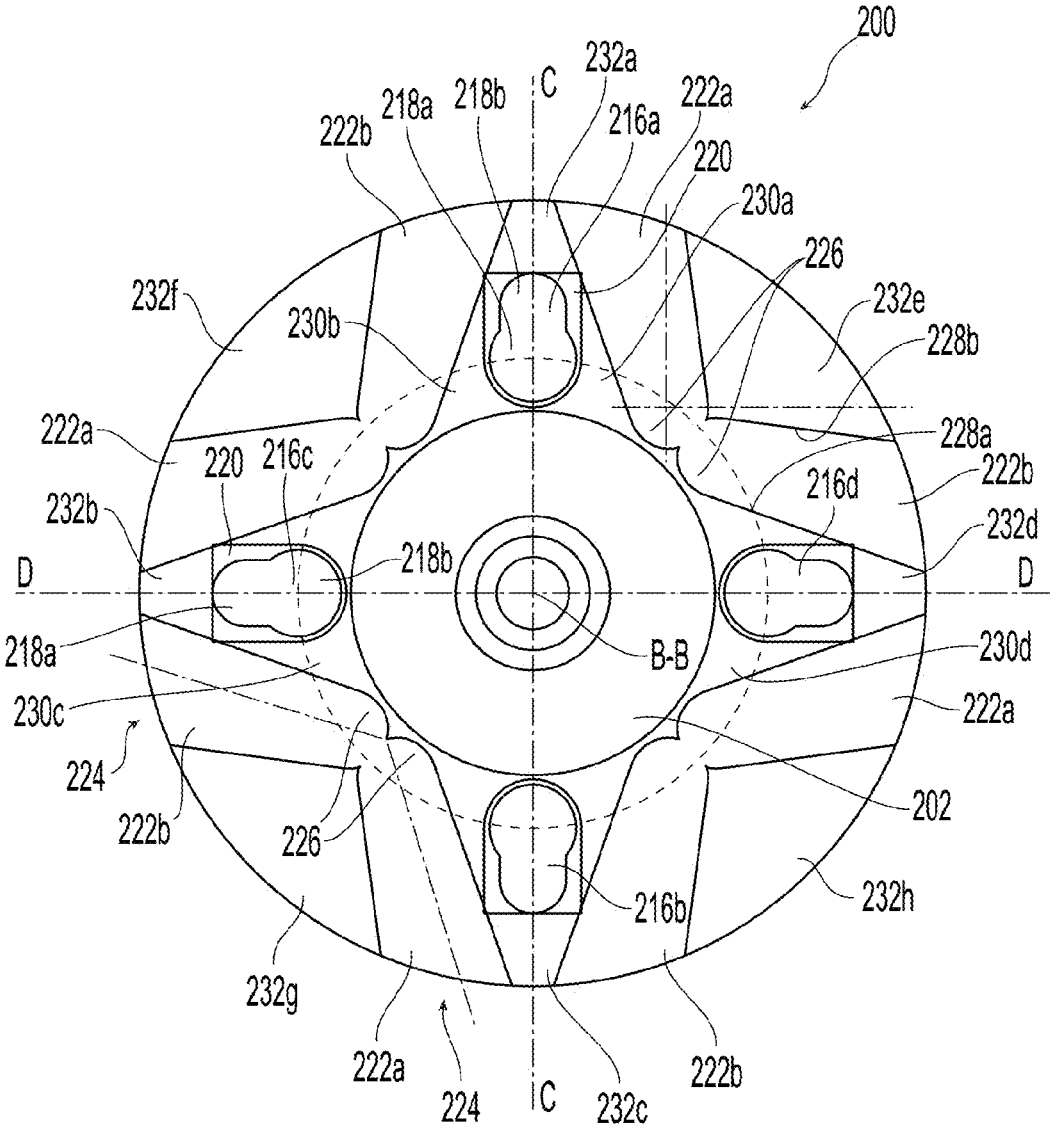
FIG. 9 is a plan view of the diffuser element used in the load screw diffuser assembly of FIG. 4.

Referring to the plan view of the diffuser 200 in FIG. 9, the diffuser 200 includes a plurality of through holes. In a preferred embodiment, the diffuser includes a first pair of diametrically opposed through holes 216*a*, 216*b* aligned along a first diffuser surface axis C-C and a second pair of diametrically opposed through holes 216*c*, 216*d* aligned along a second diffuser surface axis D-D. Each of the through holes 216*a*, 216*b*, 216*c*, 216*d* are generally key-hole shape being defined by a first circle overlapped by a second circle. For example, with reference to through hole 216*a*, the through hole is defined by the first circle 218*a*, having a first diameter preferably of about 0.05 inch and a second circle

218*b* having a diameter preferably smaller than the first diameter at about 0.04 inch. The first and second circles 218*a*, 218*b* of the through holes overlap or are in communication with another such that their centers are spaced apart from one another along their respective diffuser surface axis by a preferred distance of about 0.03 inch. The central axes of each of through holes 218*a*, 218*b* are preferably angled with respect to the diffuser axis B-B, as shown for example in FIG. 4C. Preferably, the central axes of each of the through holes 118*a*, 118*b* define an included angle of about 11 degrees relative to a line parallel with the diffuser axis B-B.

The center spacing and first and second diameters of the preferably keyhole shaped through holes 216*a*, 216*b*, 216*c*, 216*d* preferably define a relationship by which the keyholes can be scaled in size upward or downward. More specifically, the center spacing—first diameter—second diameter together define a dimensional relationship that is a multiple of 3-4-5. For example, in the preferred embodiment described above, the keyholes 216*a*, 216*b*, 216*c*, 216*d* are characterized by the 3-4-5 relationship by a factor of 0.01 so as to have the center spacing of 0.03 inches, a second diameter of 0.04 inches in the second circle and a first diameter of 0.05 inches in the first circle. Accordingly, keyhole shaped through holes 216*a*, 216*b*, 216*c*, 216*d* can vary in size from one another or from nozzle to nozzle preferably provided the 3-4-5 relationship is maintained.

Figure 5:
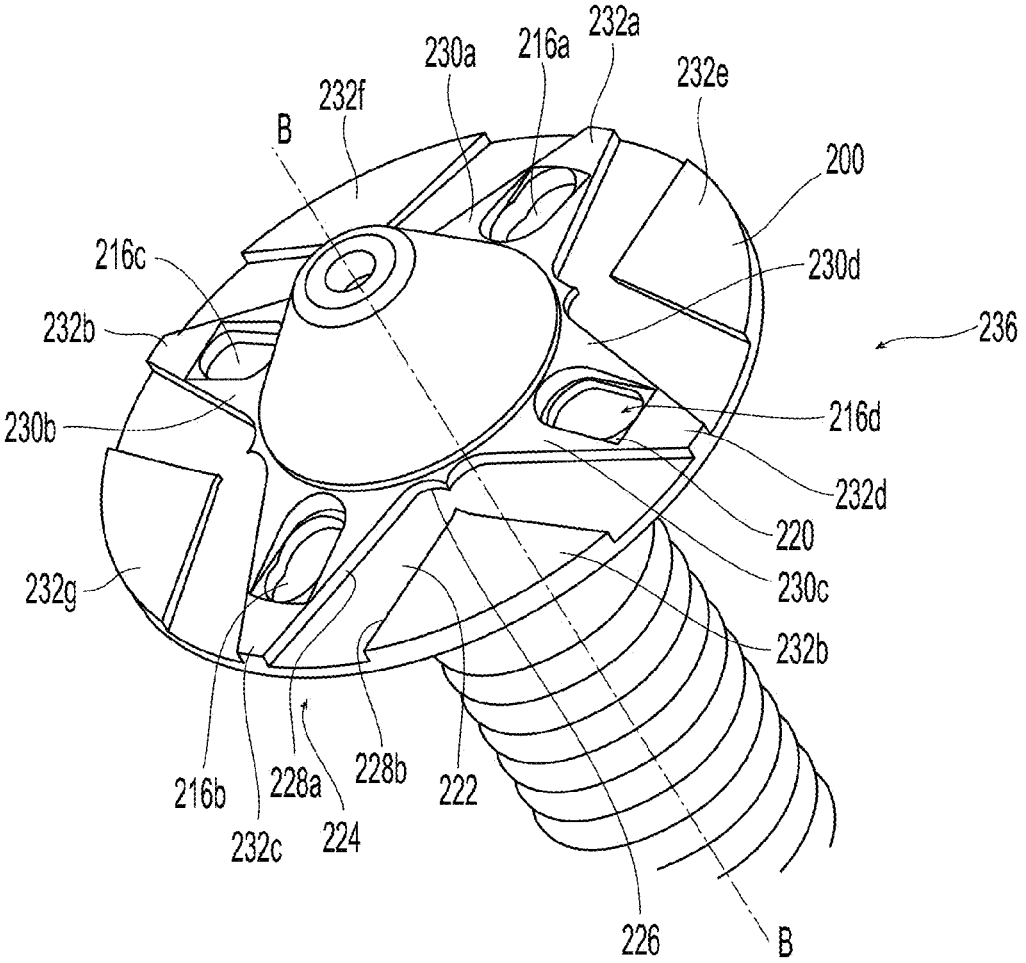
FIG. 5 is an isometric view of the load screw of FIG. 3.
Figure 6:
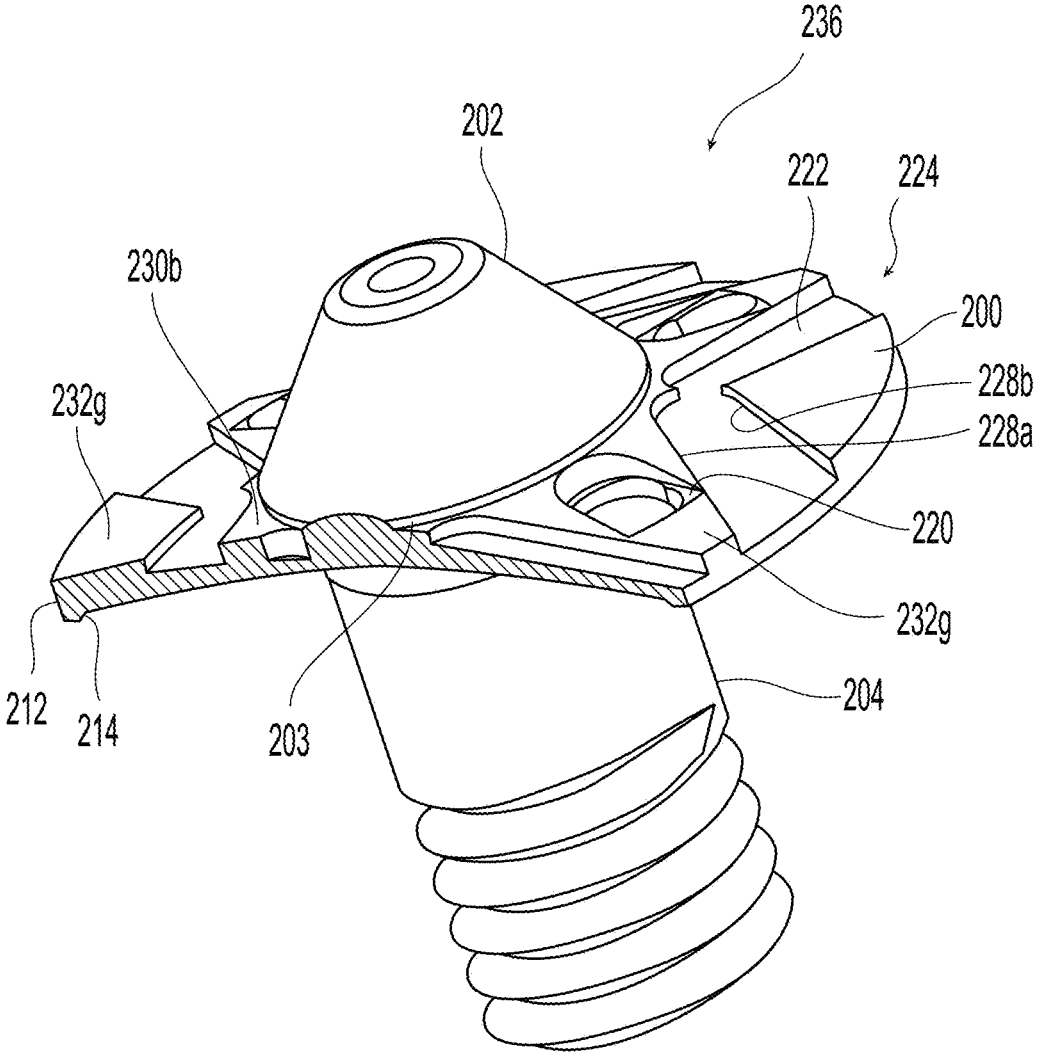
FIG. 6 is a cut-away view of the load screw of FIG. 3.

Referring to the perspective view of FIGS. 5 and 6, each of the through holes 216*a*, 216*b*, 216*c*, 1216*d* is preferably surrounded by a touchdown 220 formed in the upper surface 210*a* of the diffuser element. The touchdown 220 creates a planar surface that surrounds the through hole 216*a*, 216*b*, 216*c*, 216*d* that is preferably substantially orthogonal to the diffuser longitudinal axis B-B so as to define a step transition from the upper surface 210*a* to a maximum depth of about 0.02 inches. Accordingly, the touchdown 220 further defines a wall that extends from the planar surface in the direction of the axis B-B to surround the through holes 216*a*, 216*b*, 216*c*, 216*d*.

The touchdown 220 in the upper surface 210*a* is preferably formed by translating an end mill along a respective surface axis C-C, D-D. Because the planar surface of the touchdown is preferably perpendicular to the axis B-B, the walls of the touchdown 220 taper in the direction of the surface axis C-C, D-D due to the angled upper surface 210*a*. The wall the touchdown 220 preferably create a semicircular formation at the maximum depth of the touchdown 220 that is concentric with first circle 218*a* of the through hole 216. At the shallowest portion of the touchdown 220, a preferably rectangular opening is formed that defines a linear edge that is perpendicular to the surface axis C-C, D-D and tangential to the most peripheral edge of the second circle 118*b*. The rectangular opening of the touchdown 220 places the planar surface of the touchdown 220 continuous with the upper surface 210*a* of the diffuser. The portion of the upper surface that is continuous with the opening of the touchdown 220 defines a ledge surface 232*a*, 232*b*, 232*c*, 232*d* that can carry water flowing through the touchdown out to the peripheral edge 212 of the diffuser element.

Referring back to FIG. 9, each of the through holes is preferably centered between a pair of surface treatments. More specifically, the through holes 216*a*, 216*b*, 216*c*, 116*d* are preferably centered between a pair of channels 222*a*, 222*b*. In the inward direction, the channels 222*a*, 222*b* preferably diverge away from one another about the through hole 216*a*, 216*b*, 216*c*, and 216*d*. Each of the channels preferably initiates with an opening 224 at the peripheral edge of the diffuser element 200. In the exemplary channel 222*a* of FIG. 5, the channel 222*a* extends inwardly to terminate at an inner portion 226 between the cone 202 and the peripheral surface 212. The channel 222*a* is further defined by a pair of walls 228*a*, 228*b* that converge toward one another at the inner portion 226. The first wall 228*a* preferably diverges from a diffuser surface axis C-C, D-D at a preferred angle of about 20 degrees and more preferably an angle of about 19.5 degrees. The second wall 228*b* preferably diverges relative to the respective surface axis C-C, D-D at a preferred angle of about 8 degrees. Moreover, the walls 228, 228*b* preferably taper narrowly in the inward direction such that the channels 222*a*, 222*b* become more shallower in the inward direction. Alternatively, the channels can be of a constant depth along their length.

Adjacent channels 222*a*, 222*b* are placed in communication with one another. More specifically, the innermost portions 226 of adjacent channels 222*a*, 222*b* overlap one another such that the longitudinal axes of the channels 222*a*, 222*b* intersect one another. The channels 222*a*, 222*b* do not extend axially through the diffuser element 200. Accordingly the channels have a bottom surface that preferably extends parallel to the upper diffuser surface 210*a*.

In a preferred installation of the load screw assembly 26, the threaded shank 204 is disposed within the lower body element 222 of the nozzle 210 such that the load screw assembly axis B-B is coaxially aligned with the nozzle axis II-II. Moreover, the cone 202 is brought into a position to axially support the bulb 134 of the nozzle. In the preferred installation, the load screw assembly 236 is installed such that the surface axes C-C, D-D are each disposed at an angle of 45 degrees relative to a plane defined by the arms 118, 120 bisecting the diffuser element 200 so as to align the arms 118, 120 between adjacent through holes, for example, 216*a*, 216*c*.

The through holes, touchdown, and channels divide the upper surface 210*a* of the diffuser element 200 into spaced apart regions. For example with reference to FIG. 9, upper surface 210*a* preferably includes a first region 230 and a second region 232 in which the first region 230 is preferably radially inward of the second region 232. Each of the first and second regions are preferably symmetrical about the central diffuser longitudinal axis B-B.

In the preferred embodiment of the diffuser 200, the first region 230 has four parts 230*a*, 230*b*, 230*c*, 230*d* equiradially disposed and continuous about the cone 202. Each part 230*a*, 230*b*, 230*c*, 230*d* of the first region 230 includes a center surface disposed between two wing surfaces in which the center is defined by the intersection of the adjacent channels 222*a*, 222*b*. In the preferred installation of the load screw diffuser assembly 236, the centers of diametrically opposed parts 230*a*, 230*c* are aligned with the plane defined by the arms 118, 120 and the centers of the other diametrically opposed parts 230*b*. 230*d* are orthogonal to the plane.

In the preferred embodiment of the diffuser 200, the outer second region 232 has eight parts equiradially disposed and spaced about the cone 102. With reference to FIG. 9, half of second region is 232 is defined by the four ledge surfaces 232*a*, 232*b*, 232*c*, 232*d* in communication with the openings of the touchdowns 220. The other half of the outer second region 232 is defined by the parts 232*e*, 232*f*, 232*g*, 232*h* located between intersecting adjacent channels 222*a*, 222*b*.

The diffuser element 200, alone or in combination with one or more of the cone 202, arms 118, 120, and frame 112, provides the nozzle with the means for diffusing the fire retardant fluid in a spray pattern to define a coverage area. Preferably, the frame 112, diffuser element 200 and cone 202 cooperate to distribute a flow of fire retardant fluid from the upper body element 113 to define a preferred spray pattern. The spray pattern provides a preferred flux density for a given area beneath the nozzle in response to a given pressure of fluid supply when the nozzle is disposed at a specific height above floor of the area being protected. The preferred embodiment of the nozzle 100 is to be commercially embodied as an AQUAMIST® Nozzle: AM27. A draft data sheet of the to-be-commercialized embodiment of the nozzle 100 is included in U.S. Provisional Application No. 61/193,874 which is incorporated by reference to incorporate the data sheet. The draft data sheet is entitled, *TFP*2227:AQUAMIST® Nozzles: AM27 Automatic (*Closed*) (Draft Sep. 22, 2008).

Figure 11:
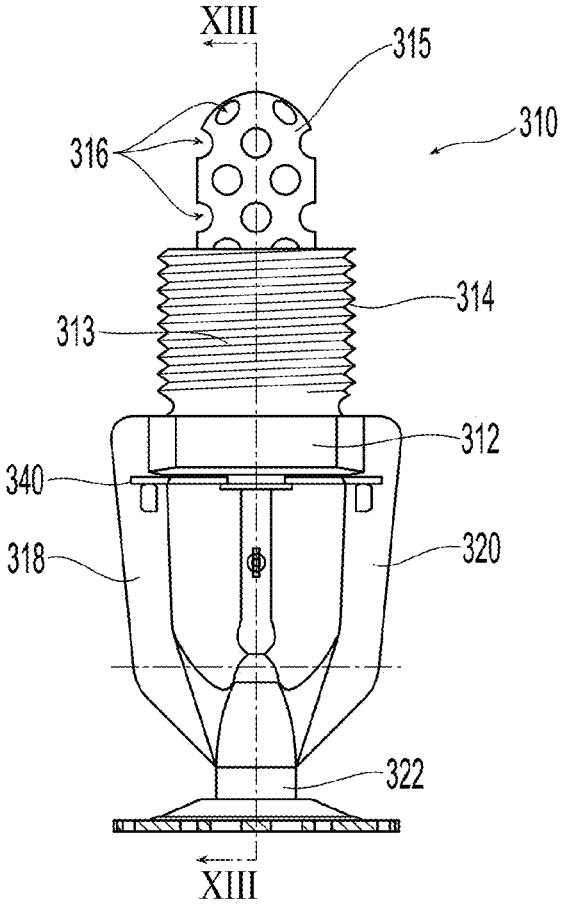
FIG. 11 is an elevation view of a preferred fire protection nozzle.

Shown in FIG. 11 is the other preferred nozzle 18' embodied as a normally closed automatically operating nozzle 300 includes a frame 312 having an upper body element 313 with external threads 314 for coupling the frame 312 to a fire fighting fluid supply system (not shown) such as for example, a branch line of a water supply pipe. Alternatively, the upper body 313 can be configured for other type connections to the fluid supply, for example, the frame 312 can include a groove, for a groove type coupling connection to the fluid supply. Disposed within upper body element 313 is a strainer 315. The strainer 315 includes a plurality of openings 316 to allow passage of fire fighting fluid while filtering out debris which may clog or damage the internal passageway of the nozzle 300.

Depending from and preferably symmetrically about the body 313 are a pair of frame arms 318, 320. The arms 318, 320 extend axially and preferably converge about a lower body element 322 located distally of the upper body element 313. Preferably, the arms 318, 320 are formed integrally with the upper and lower body elements 313, 322. The frame 312 is preferably machined from a cast body of, for example brass, in which the upper body element 313, arms 318, 320 and lower body element 322 are integrally formed. The upper and lower body elements 313, 322 are preferably coaxially spaced from one another along the nozzle axis XIII-XIII. The lower body element 322 is preferably elliptical to frustroconical in shape having a proximal portion that converges in the direction of the upper body element 313 toward the axis XIII-XIII.

Figure 13:
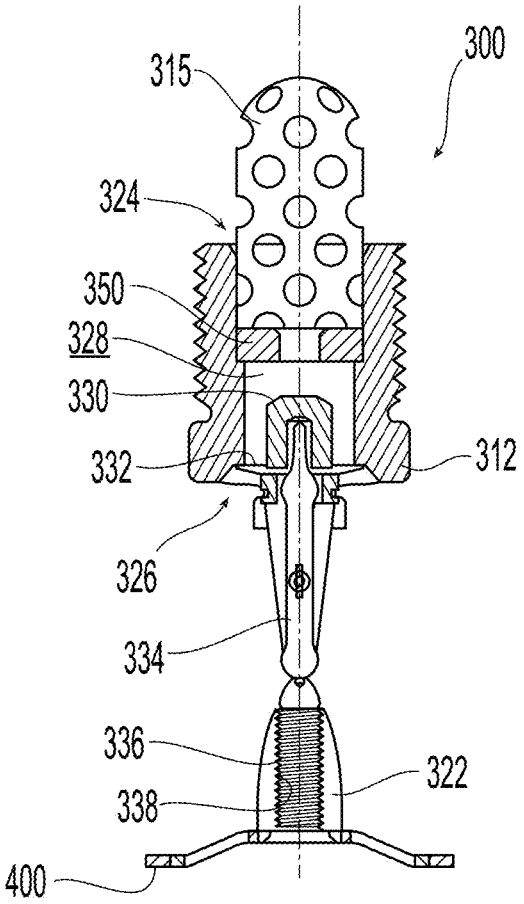
FIG. 13 is a cross-sectional view of the nozzle of FIG. 11 along line II-II.

Referring to the cross-sectional view of the nozzle 300 in FIG. 13, the upper body element 313 has an inlet 324 and an axially spaced outlet 326 to define therebetween an axially extending passageway 328 through which the fire fighting fluid can pass. When the nozzle is in the closed and unactuated condition, disposed within the outlet 326 is a seal assembly to seal the passageway and prevent the flow of fluid from the passageway 328. The seal assembly preferably includes a button 330 having a spring seal 332 disposed about it. The spring seal 332 engages a surface of the outlet 326 to form a fluid tight seal and prevent liquid from the passageway 328.

A thermally sensitive element 334 is engaged with seal assembly to maintain the seal assembly within the outlet 326 to prevent the flow of fluid from the passageway 328. Preferably the thermally sensitive element 334 is a bulb 334 that is thermally rated to rupture in response to a threshold temperature of a fire. The bulb 334 provides for automatic actuation of the nozzle 300 in response to a sufficient level of heat by rupturing in response to the fire so as to disengage the button 330 and allow for the release of fire fighting fluid from the passageway 328. In the preferred embodiment, the thermally responsive element can have a temperature ratings ranging between about 125° F. to about 300° F., and more preferably is any one of 135° F., 155° F., 175° F. 200° F., and 286° F. The bulb 334 is preferably configured with a Response Time Index (RTI) of 50 (meters-seconds)$^{1/2}$ or less and preferably about 36 (meters-seconds)$^{1/2}$ so as to have a fast response, and more preferably, the bulb 334 is such that the nozzle 330 can be listed as a quick response device by the appropriate listing agency. A load screw assembly 336 is preferably provided to support the bulb 334 in its engagement with the button 330 to maintain the nozzle in its unactuated configuration. The load screw assembly 336 is preferably threaded and engaged within a bore 338 of the lower body element 322 of the frame 12.

Referring back to FIG. 11, an ejection spring 340 imposes a lateral force on the seal assembly such that when the release element 334 bursts at a predetermined temperature due to exposure to the abnormally high temperatures caused by a fire, the button 330 and spring seal 332 are thrown to the side from their normal or standby sealing position, thereby to allow fluid to discharge through the passageway 328 and impinge upon a diffuser element 400, secured to the loading screw assembly 336 to form the desired fluid mist spray pattern.

Figure 12:
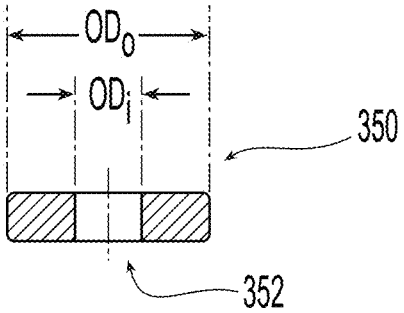
FIG. 12 is a cross-sectional view of the orifice insert for use in the nozzle of FIG. 11.

FIG. 12 shows disposed within passageway 328, distal of the inlet 324, an orifice insert 350 preferably supported by a shelf formed along the interior walls of the upper body element 313 forming the passageway 328. More specifically, the orifice insert 350 is dimensioned to define an orifice outer diameter ODo, preferably of about 0.5 inch and more preferably ranging from about 0.494 to about 0.498 inches, so as to form a slip fit within the passageway 328 of the upper body element 313 and in engagement with the shelf formed along the interior walls forming the passageway. The orifice insert 350 further includes an interior through bore 352 through which incoming fluid flows. The orifice insert 350 and through bore 352 preferably is configured with an orifice inner diameter ODi of about 0.17 inches and is more preferably about 0.172 inches so as to define a K-factor for the nozzle 10 of about 9.2 (lpm/bar$^{1/2}$). Alternatively, the orifice insert 50 and its through bore 52 can define a K-factor in the range of about 0.10 to 1.00 gpm/(psi)$^{1/2}$, preferably in the range from about 0.5 to 0.70 gpm/(psi)$^{1/2}$, and more preferably is about 0.59 gpm/(psi)$^{1/2}$ (8.5 lpm/bar$^{1/2}$) Moreover, although the orifice insert is substantially circular in its plane view, the insert 50 can be alternatively configured with a non-circular shape.

Upon actuation of the nozzle 300, the sealing system is released and a vertically directed, relatively coherent, single stream of water passes through the orifice insert 350 and its through bore 352 for discharge from the outlet 326 to impact the diffuser element 400 for distribution in a preferably radially outward and downward spray pattern beneath the nozzle 300. The diffuser element 400 is disposed coaxial with and preferably affixed about the lower body element 322. More preferably the diffuser element 400 is disposed about the distal end of the lower body element 322, external of and distal to the frame arms 318, 320.

Shown in FIGS. 14, 15, 16, 17 and 18 is the preferred diffuser element 400 in plan, cross-sectional and detailed views. In plan, the diffuser element 400 defines a substantially circular shape with an outer peripheral edge 402 formed about a central diffuser axis Y-Y. The diffuser element includes a central bore 404 sized to receive the lower body element 322 of the frame 312. Referring more specifically to the views of FIGS. 16 and 17, the diffuser element 400 is a substantially frustroconical member having an upper surface 406 and a lower surface 408 that is preferably substantially parallel to the upper surface 406.

The upper and lower surfaces 406, 408 are spaced apart so as to define a thickness of the diffuser element 400, which is preferably about 0.05 inches. When installed, the upper surface 406 of the diffuser faces the outlet 426 of the nozzle 300 so as to be impacted by the stream of fluid discharged from the insert orifice 350.

The diffuser element 400 is preferably formed such that the upper surface 406 has a plurality of surfaces that are disposed at angles with respect to one another. Preferably, the diffuser element 400 includes a substantially planar central base region 406*a* and an outer annular substantially planar region 406*c* in which each of the central and outer regions of the upper surface 406 are disposed orthogonal to the nozzle axis XIII-XIII when the diffuser element 400 is installed about the lower body element 322. The diffuser element 400 is further preferably formed such that the upper surface 406 defines a generally annular intermediate region 406*b* between the central region 406*a* and the outer region 406*c*. The intermediate region 406*b* preferably defines a truncated cone slanted at a downward angle, α, relative to a plane parallel the central and outer planar regions 406*a*, 406*b*. The angle α preferably ranges between about e.g. in the range of about 15° to about 60° and is more preferably about 18°. The intermediate region 406*b* is preferably substantially continuous with the central region 406*a* and the outer region 406*c* such that the diffuser element defines an axial spacing H between the central and outer regions 406*a*, 406*c* which ranges from about 0.14 to about 0.15 inches and is preferably 0.148 inches.

Figure 15:
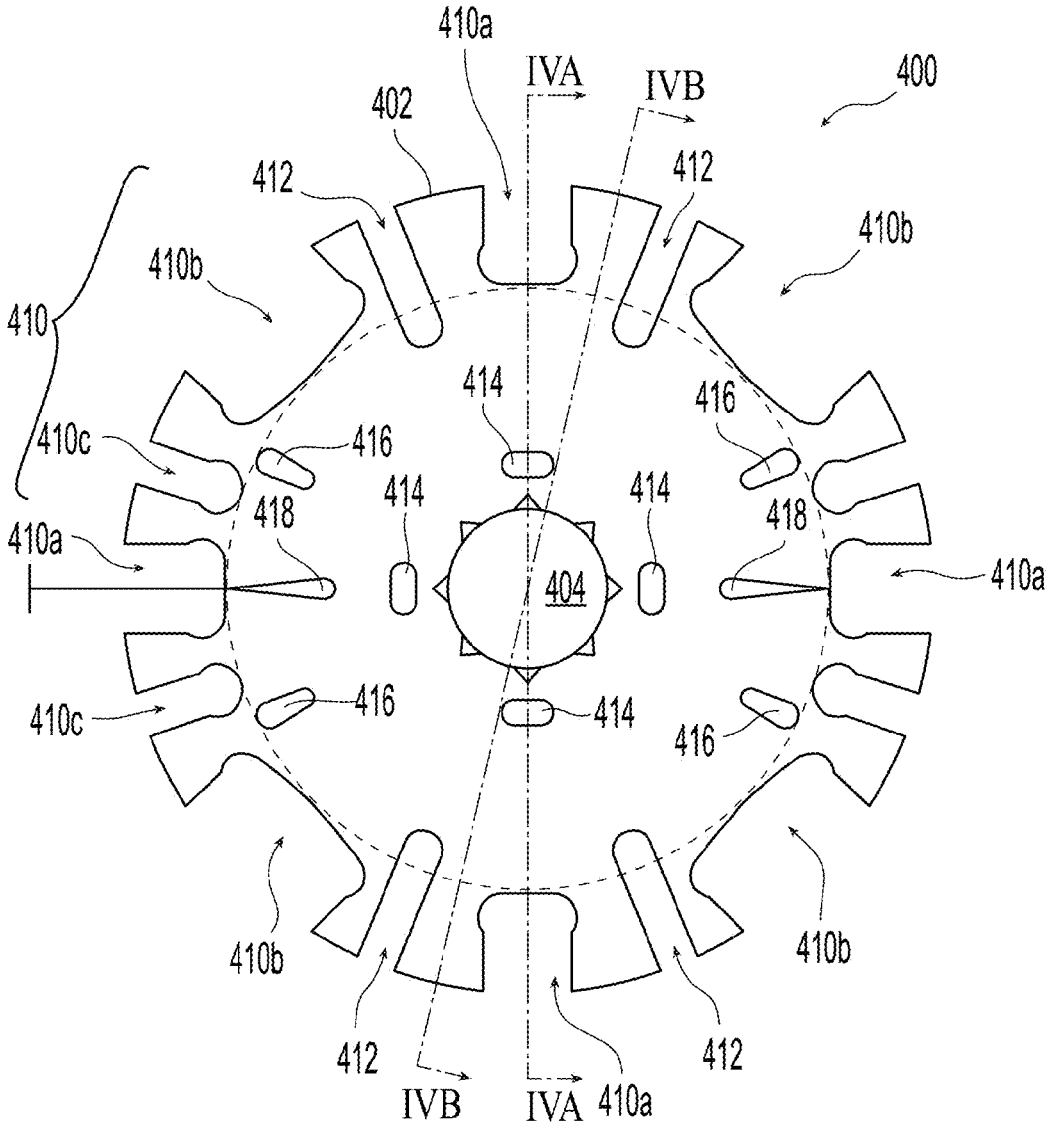
FIG. 15 is a plan view of a preferred diffuser element for use in the nozzle of FIG. 11.
Figure 16:
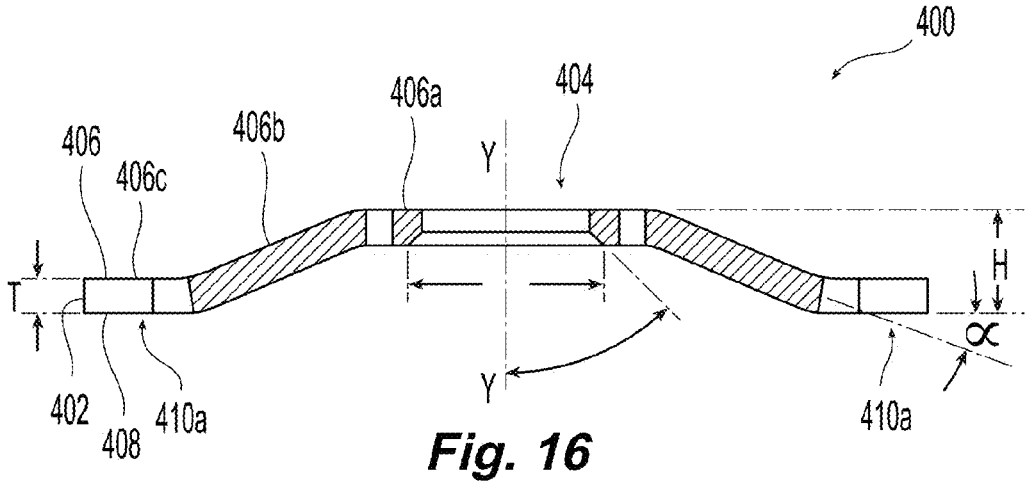
FIG. 16 is a cross-sectional view of the diffuser element of FIG. 15 along line IVA-IVA.

Referring to the plan view of FIG. 15, the surfaces of the diffuser element 400 further define a plurality of slots and through holes that through which fluid flows to form the spray pattern of the nozzle 300. In the preferred diffuser element 400, the plurality of slots preferably includes at least three groups of slots 410, 412 and 418. Generally, each of the slots has an initial portion, a terminal portion and an intermediate portion that is continuous and disposed between the initial and terminal portions. The initial portion of the slot is defined by an opening along the peripheral edge 402 of the diffuser element 400. The opening forms a pair of spaced apart walls in the diffuser element 400 that extend inward toward the diffuser axis Y-Y so as to define the intermediate portion of the slot. In each of the slots of the diffuser element 400, the pair of walls converge to form the end face of the slot and define the terminal end portion of the slot. The spacing between the walls define the width of the slot. The spacing between the walls of the slot can be constant along the length of the slot or alternatively the spacing between the walls may vary. Moreover, the wall spacing of the slot can vary either continuously along the slot length or vary discretely such that one portion of the slot varies from another portion of the slot, for example, the terminal portion may be wider than the initial or intermediate portion of the slot.

Figure 18:
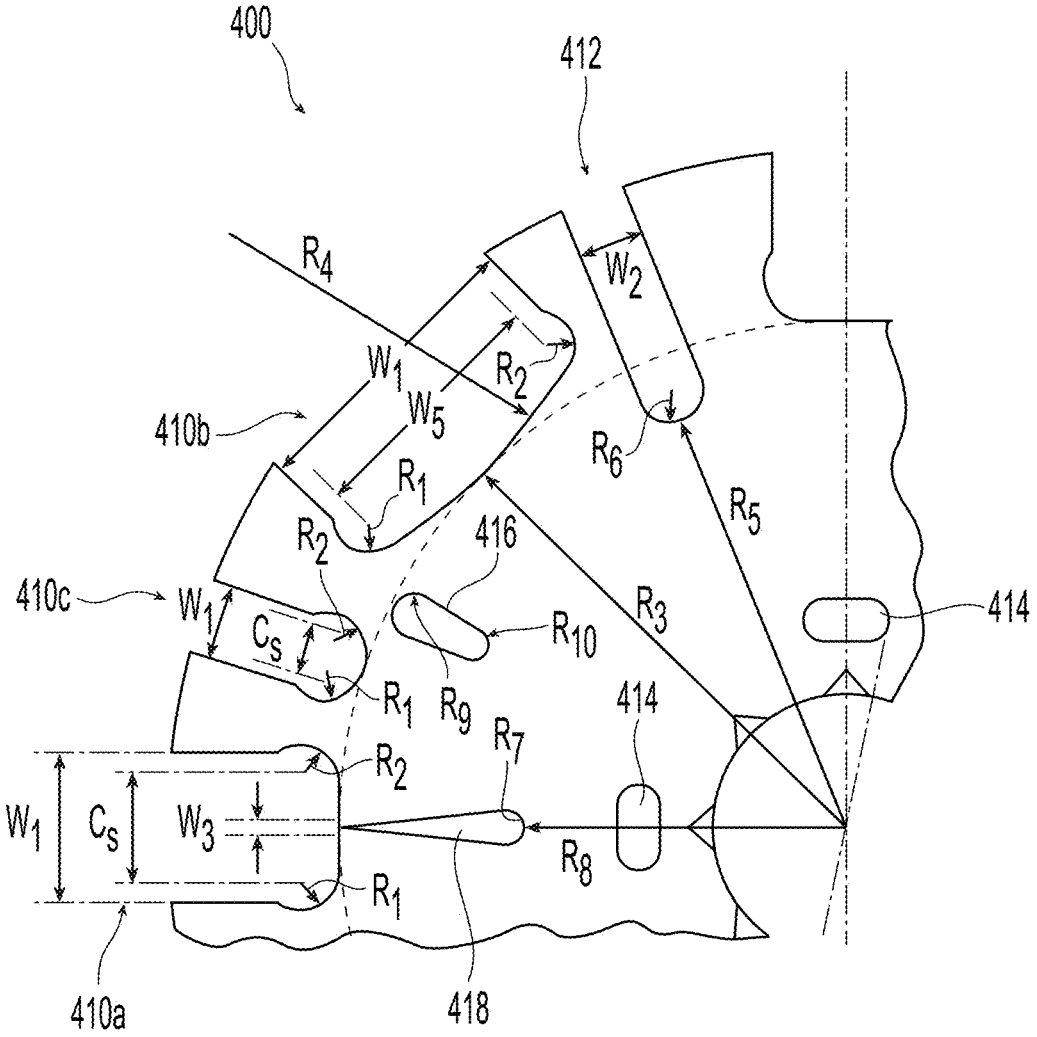
FIG. 18 is a detailed view of the diffuser element of FIG. 15.
Figure 19A:
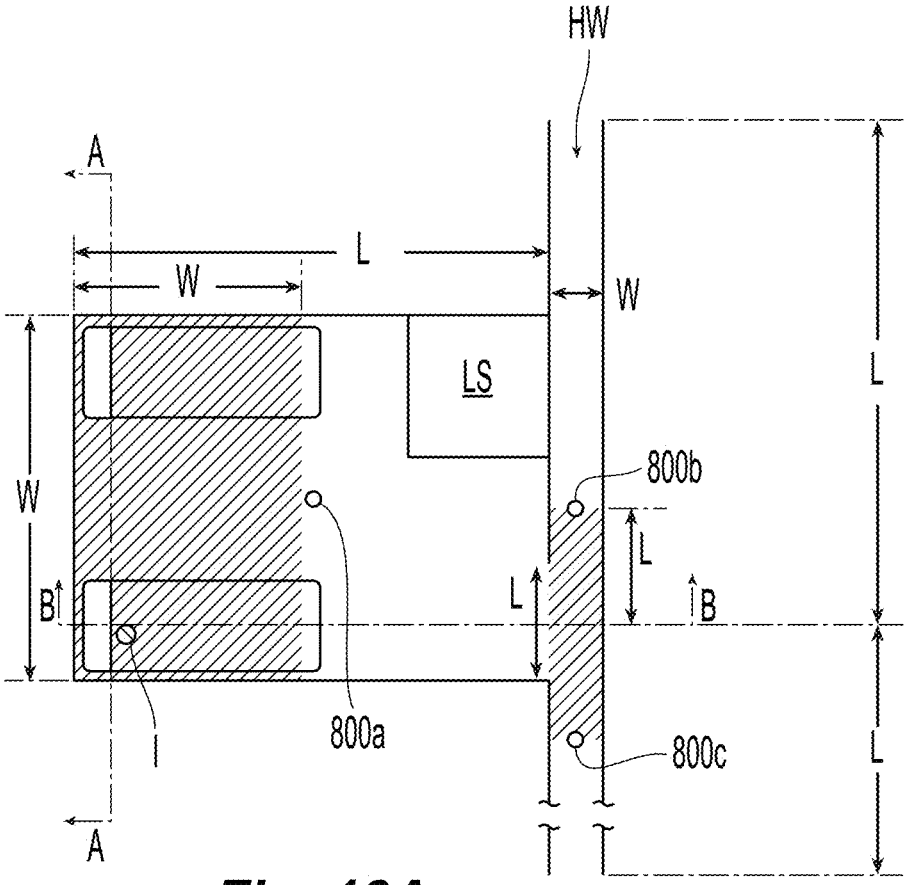
FIG. 19A-19B is a schematic of a Small Compartment fire set up for fire testing of a preferred nozzle.
Figure 19B:
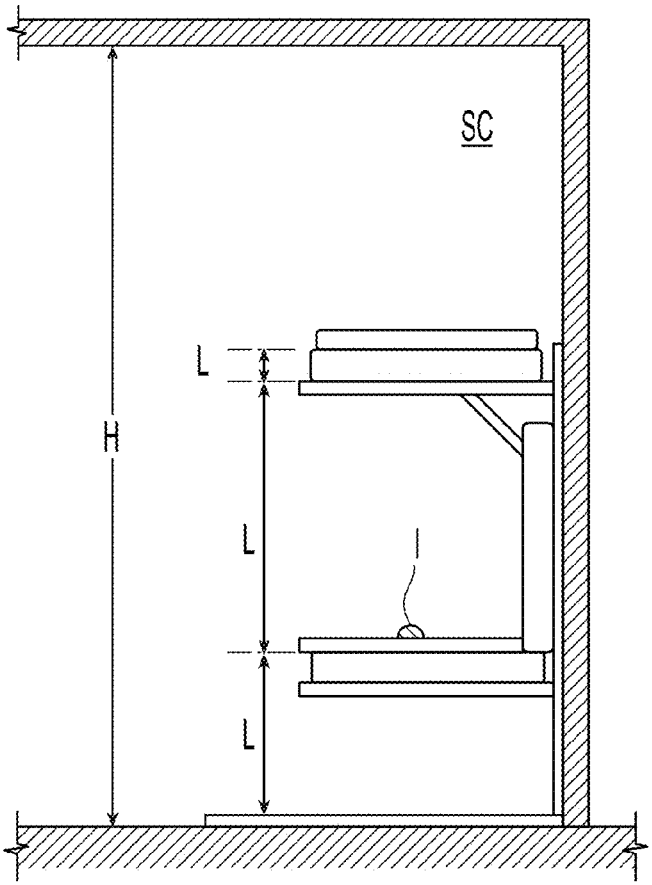

In the preferred embodiment of the diffuser element 400, the groups of slots 410, 412, 418 vary with respect to one or more of the slot features such as, for example, slot width, slot length, and/or geometry of any one of the initial, intermediate or terminal portions of the slot. Referring to FIG. 18, the diffuser element includes a first group of slots 410 in which the opening and wall of the slot are dimensioned to define a preferred constant width $W_1$ along the length of the slot between the initial and intermediate portions. The terminal portions of the slots 410 of the first group 410 are defined by a pair of radii R1 and R2 whose centers are spaced apart by a distance Cs. The center spacings Cs are preferably dimensioned such that the terminal portion of the slot defines a slot width greater than the slot width W1 of the initial or intermediate portions of the slot. The first group of slots 410 preferably includes a total slot length that is defined by the end face of the slot being tangential to a circle having a radius R3 from the diffuser axis.

Within the first group of slots 410, the preferred embodiment of the diffuser element 400 includes at least three types of slots 410*a*, 410*b*, 410*c* which vary with respect to one or more of the slot features such as, for example, slot width and/or geometry of any one of the initial, intermediate or terminal portions of the slot. For example, the slot widths W1 of the initial and intermediate portions vary from slot type to slot type as do the center spacings Cs vary from slot type to slot type. Moreover the end faces of the slots in the terminal portion of the slots in the first group can be further defined by another radius R4 whose center is located at a distance further outward from the peripheral edge 402. The end face portion defined by the additional radius R4 joins the end face portions defined by the spaced apart radii R1 and R2.

In a second group of slots 412, the slot opening and walls are preferably spaced to define a slot width W2 that is substantially constant along the slot length from the initial portion through the intermediate portion of the slot. The terminal portion and end face of the slot is preferably defined by a radius R6 whose center is centrally disposed between the two walls of the slot so as to be located along the central axis of slot. The end face in the terminal portion of the slot is preferably located at a radial distance R5 from the central axis Y-Y of the diffuser element 400. Preferably, the radial distance R5 from the diffuser axis of the second group of slots 412 is less than the radial distance R3 from the diffuser axis of the first group of slots 410 such that the slot length of the second group of slots 412 is greater than the slot length of the first group of slots 410.

The diffuser element 400 preferably includes a third group of slots 418 having its opening along a peripheral edge 402 and preferably located along the end face of one of the other group of slots 410, 412. More preferably the opening of a slot in the third group of slots 418 has its opening located along the end face and in communication with the terminal portion of a slot in the first group of slots 410. The walls defining the slot width W3 in the third group preferably diverge away from one another in the inward direction such that the slot width broadens at preferably constant rate from the initial portion through the intermediate portion in the inward direction. The terminal portion and end face of the slot is preferably defined by a radius R7 whose center is centrally disposed between the two walls of the slot so as to be located along the central axis of the slot. The end face in the terminal portion of the slot is preferably located at a radial distance R8 from the central axis Y-Y of the diffuser element 400. Preferably, the radial distance R8 from the diffuser axis of the third group of slots 418 is less than either the radial distance R6 from the diffuser axis of the second group of slots 412 or the radial distance R3 from the diffuser axis of the first group of slots 110 such that the terminal portion of the third group of slots is located more radially inward than the terminal portions of either the first group 110 or second group 112 of slots.

In an alternate embodiment, the formation of the diffuser element 400 can bring the walls at the initial portion of the slots of the third group 418 into close contact such that the third group of slots 418 act as through holes forming a substantially tear dropped shaped opening in the diffuser element that is completely bound by an effectively continuous wall.

The diffuser element 400 preferably includes a plurality of through holes. More preferably, the diffuser element 400 includes a plurality of groups of through holes 414, 416 with a geometry that preferably varies group to group.

Figure 17:
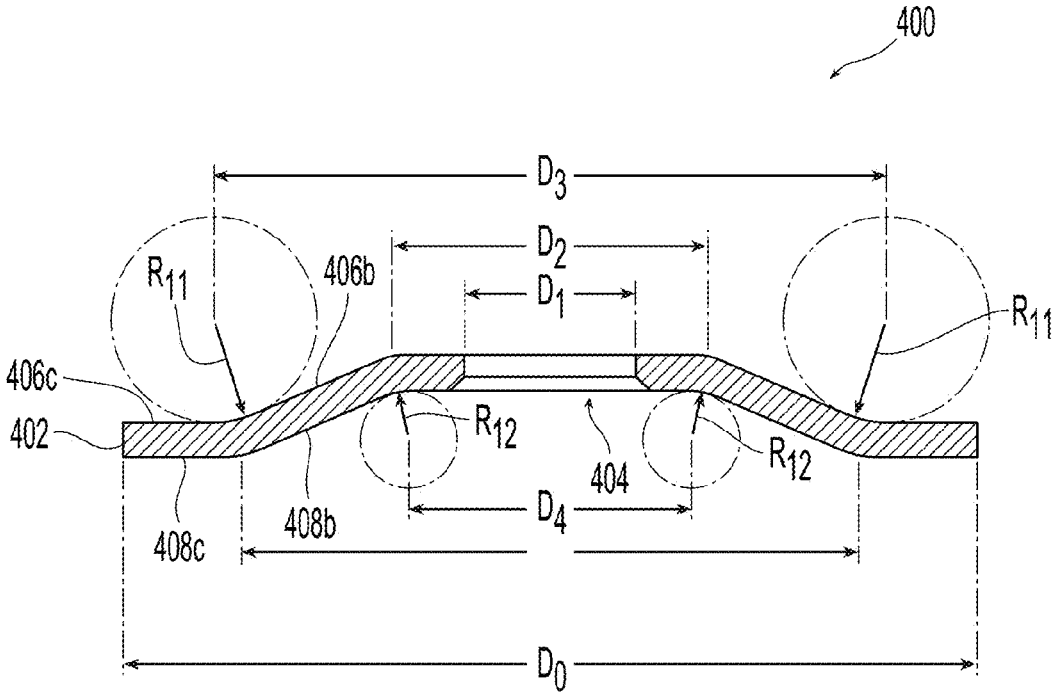
FIG. 17 is a cross-sectional view of the diffuser element of FIG. 15 along line IVB-IVB.

For example, in FIG. 17, the first group of through holes 414 is preferably substantially elliptical in shape and the second group of slots 416 is substantially key-holed shaped. More specifically, the first group of through holes 414 are preferably elongated so as to have a major axis in the direction of elongation and a shorter minor axis orthogonal to the major axis. The minor axis is preferably intersects the central axis Y-Y of the diffuser element 400.

The second group of through holes 416 are also preferably elongated so as to have a major axis in the direction and a minor axis orthogonal to the major axis. The major axis preferably intersects the central axis Y-Y of the diffuser element 400. The second group of through holes 416 are each defined by a first radius R9 and a second radius R10 each having a center disposed along the major axis of the through hole 416. The second radius R10 is preferably smaller than the first radius R9 so that the through hole 416 is substantially key holed shape, tapering narrowly in the inward direction.

The diffuser element 400 is preferably formed by bending a blank that is punched or cut with the various plurality of slots and through holes. As shown in the cross-sectional view of the diffuser element 400 in its final form, in FIG. 17, the outer planar region and the peripheral edge 402 define the maximum outer diameter D0 of the diffuser 400 so as to preferably be about 1.25 inches and more preferably 1.24 inches. The central bore 404 preferably defines an interior diameter D1 of about 0.25 inches and the planar central based region 406*a* defines a preferred base diameter D2 of about 0.46 inches. The angled intermediate region 406*b*, 408*b* preferably defines a radiused transitions contiguous with the inner central region 406*a*, 408*a* and the outer peripheral region 406*c*, 408*c*. More specifically the formation bend between the outer region and the intermediate region defines along the upper surface 106 a preferred transition radius R11 that is constant such that its center circumscribes a circle about the diffuser axis Y-Y having a preferred diameter D3 of about 1 inch. The formation bend between the central region and the intermediate region defines along the lower surface 408 a preferred transition radius R12 that is constant such that its center circumscribes a circle about the diffuser axis Y-Y having a preferred diameter D4 of about 0.411 inches.

Figure 14:
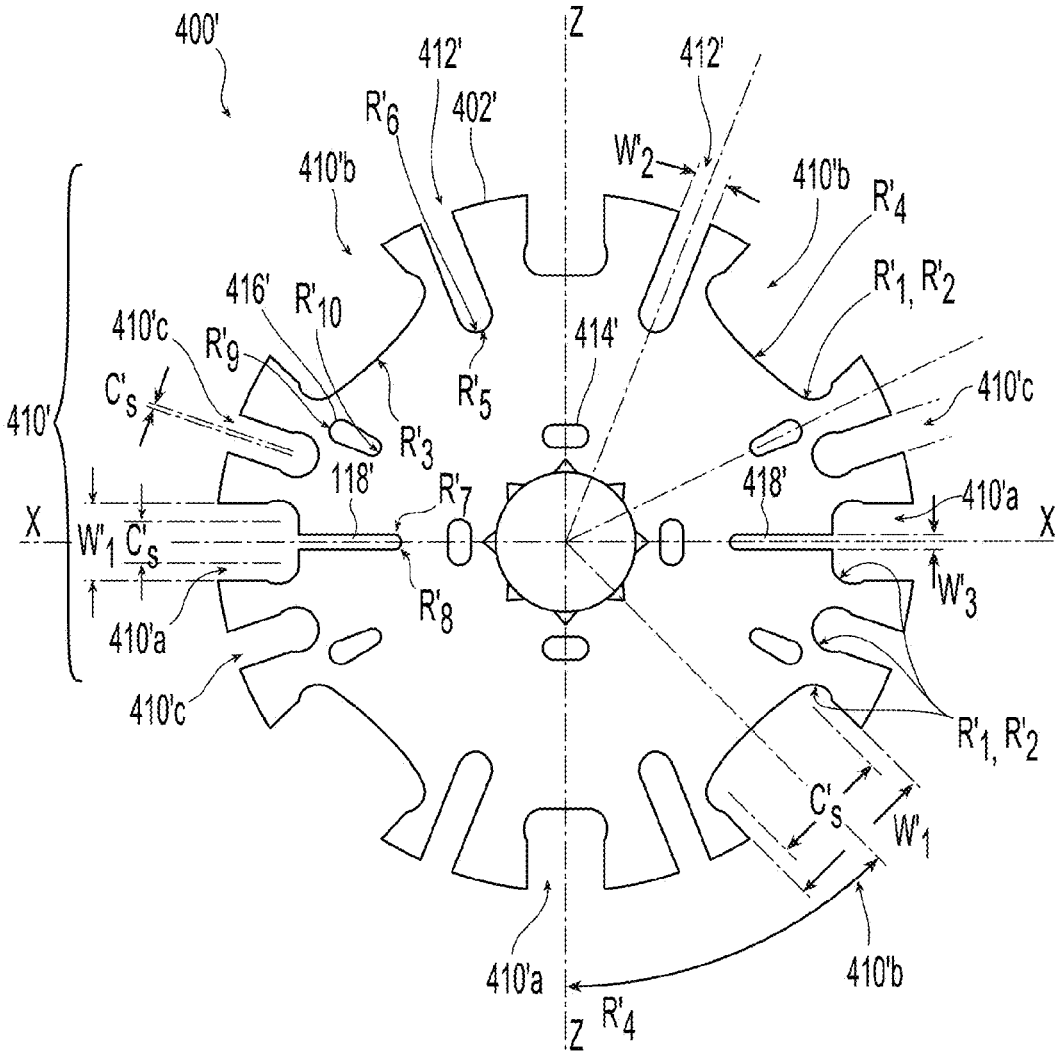
FIG. 14 is a preferred blank for formation of a diffuser element in the nozzle of FIG. 11.

The diffuser element 400 is preferably fabricated from a phosphor bronze alloy UNS52100, Temper H02, per ASTM B103. Shown in FIG. 14 is a preferred blank 400' to be bent for fabrication and formation of the preferred diffuser element 400. The preferred blank 400' is initially a substantially flat or planar member having a substantially circular shape with an outer peripheral edge 402 formed about the blank central axis. The blank 400' and the peripheral edge 402 defines a preferred maximum diameter for the blank 400' being about 1.25 inches. The blank 400' includes a central bore 404' preferably formed by a serrated punch having a diameter of about 0.25 inches. The blank 400' also includes a preferred grouping of slots 410', 412', 418' and through holes 414', 416' which in their final form, define the preferred plurality of slots and through holes of the diffuser element 400.

In the preferred blank 400', each of the plurality of slots has an initial portion, a terminal portion and an intermediate portion that is continuous and disposed between the initial and terminal portions. The initial portion of the slot is defined by an opening along the peripheral edge 402' of the preferred blank 400'. The opening forms a pair of spaced apart walls in the preferred blank 400' that extend inward toward the blank axis Y'-Y' so as to define the intermediate portion of the slot. In each of the slots of the preferred blank 400', the pair of walls converge to form the end face of the slot and define the terminal end portion of the slot.

In the preferred embodiment of the preferred blank 400', the groups of slots 410', 412', 418' vary with respect to one or more of the slot features such as, for example, slot width, slot length, and/or geometry of any one of the initial, intermediate or terminal portions of the slot. The preferred blank 400' includes a first group of slots 410' in which the opening and wall of the slot are dimensioned to define a preferred constant width W'1 along the length of the slot between the initial and intermediate portions. The terminal portions of the slots 410' of the first group 410' are defined by a pair of radii R'1 and R'2 whose centers are spaced apart by a distance Cs'. The center spacings Cs' are preferably dimensioned such that the terminal portion of the slot defines a slot width greater than the slot width W1' of the initial or intermediate portions of the slot. The first group of slots 410' preferably includes a total slot length that is defined by the end face of the slot being tangential to a circle having a radius R'3 from the diffuser axis that is preferably about 0.46 inches.

Within the first group of slots 410', the preferred embodiment of the blank 400' includes at least three types of slots 410'*a*, 410'*b*, 410'*c* which vary with respect to one or more of the slot features such as, for example, slot width and/or geometry of any one of the initial, intermediate or terminal portions of the slot. For example, the slot widths W1 of the initial and intermediate portions vary from slot type to slot type as do the center spacings C's vary from slot type to slot type. More specifically, the first type of slots 410'*a* have a center spacing C's of about 0.08 inch; the second type of slots 410'*b* have a preferred center spacing C's of about 0.2 inch; and the third type of slots 410'*c* have a preferred center spacing C's of about 0.01 inch. Moreover the end faces of the slots in the terminal portion of the slots in the first group can be further defined by another radius R'4 whose center is located at a distance outward from the peripheral edge 402. For example, the end faces in the first and second type of slots 410'*a* and 410'*b* are preferably by the additional radius R'4 being about 0.5 inches and joining the end face portions defined by the spaced apart radii R'1 and R2. Preferably, the first and second radii R'1, R'2 are about 0.04 inch.

In a second group of slots 412', the slot opening and walls are preferably spaced to define a slot width W'2 that is preferably about 0.06 inch and substantially constant along the slot length from the initial portion through the intermediate portion of the slot. The terminal portion and end face of the slot is preferably defined by a radius R'6 whose center is centrally disposed between the two walls of the slot so as to be located along the central axis of slot and preferably having a length of about 0.03 inch. The end face in the terminal portion of the slot is preferably located at a radial distance R'5 from the central axis of the blank 400'. Preferably, the radial distance R'5 from the diffuser axis of the second group of slots 412 is less than the radial distance R'3 from the diffuser axis of the first group of slots 410 such that the slot length of the second group of slots 412 is greater than the slot length of the first group of slots 410. More preferably, the radial distance R'5 is about 0.4 inches.

The blank 400' preferably includes a third group of slots 418' having its opening along a peripheral edge 402' and preferably located along the end face of one of the other group of slots 410', 412'. More preferably the opening of a slot in the third group of slots 418' has its opening located along the end face and in communication with the terminal portion of a slot in the first group of slots 410'. The walls defining the slot in the third group preferably are preferably parallel so as to have slot width W'3 of about 0.03 inches. The terminal portion and end face of the slot is preferably defined by a radius R'7 whose center is centrally disposed between the two walls of the slot so as to be located along the central axis of slot and having a length of about 0.02 inch. The end face in the terminal portion of the slot is preferably located at a radial distance R'8 from the central axis Y-Y of the diffuser element 400. Preferably, the radial distance R'8 from the diffuser axis of the third group of slots 418 is less than either the radial distance 55 from the diffuser axis of the second group of slots 412 or the radial distance R'3 from the diffuser axis of the first group of slots 410' such that the terminal portion of the third group of slots is located more radially inward than the terminal portions of either the first group 410' or second group 412' of slots. The radial distance R'8 is preferably about 0.03 inch.

The preferred blank 400' preferably includes a plurality of groups of through holes 414', 416'. More specifically, the first group of through holes 414' are preferably elongated so as to have a major axis in the direction of elongation and a shorter minor axis orthogonal to the major axis. The minor axis is preferably intersects the central axis Y'-Y' of the blank 400'. The through hole 414' preferably includes radiused ends having a preferred radii of about 0.02 inch so as to define the maximum width of about 0.04 inch for first group of through holes 414'. The centers of the radii defining the ends of the through hole 414' are preferably spaced apart along the major axis by a distance of about 0.04 inch. The point of intersection between the major and minor axes of the through hole in the first group of through holes 414' is preferably located at a radial distance of about 0.21 inches from the center axis of the blank 400'.

The second group of through holes 416' are also preferably elongated so as to have a major axis in the elongated direction and a minor axis orthogonal to the major axis. The major axis preferably intersects the central axis Y'-Y' of the blank 400'. The second group of through holes 416' are each defined by a first radius R'9 and a second radius R'10 each having a center disposed along the major axis of the through hole 416'. The second radius R'10 is preferably smaller than the first radius R'9 so that the through hole 416' is substantially key holed shape, tapering narrowly in the radially inward direction. Moreover, the centers of the radii R'9, R'10 are preferably spaced along the major axis by distance of about 0.06 inches. More preferably, the first radius R'9 of the second group of through holes 416' is preferably about 0.02 inch so as to define a maximum width for the through holes being about 0.045 inches. The second radius R'10 of the second group of through holes 416' is preferably about 0.02 inch so as to define a minimum width of the through holes 416' being about 0.03 inch. Preferably, the center of the second radius 410 is located at a radial distance of about 0.4 inch from the central axis of the blank 400'.

Each group of slots and through holes is preferably symmetrically and equiradially disposed over the diffuser element 400. Accordingly, the blank 400' is configured with the slots 410, 412, 418 and through holes 414, 416 in the preferred relative angular relationships. More specifically, the first type of slots 410'*a* preferably include two pairs of diametrically opposed slots; each pair disposed respectively disposed on orthogonal axes Z-Z, X-X. The second type of slots 410'*b* of the first group 410' preferably includes two pairs of diametrically opposed slots disposed slots; each pair disposed on a pair of orthogonal axes preferably located forty-five degrees (45°) relative to the axes X-X, Z-Z of the first type of slots 410'*a*. The third type of slots 410'*c* of the first group 410' preferably includes two pairs of diametrically opposed slots; each pair disposed respectively on a pair of intersecting axes located at an angle of about eighteen degrees (18°) relative to one of the axes X-X, Z-Z of the first type of slots 410'*a*.

The second group of slots 412' preferably includes two pairs of diametrically opposed slots; each pair disposed respectively on a pair of intersecting axes located at an angle of about eighteen degrees (18°) relative to the other of the axes X-X, Z-Z of the first type of slots 410'*a* such that radially adjacent slots of the third type 410'*c* of the first group 410' and the slots of the second group 412' are radially spaced by about fifty degrees (50°).

The third group of slots 418' preferably includes a pair of diametrically opposed slots preferably axially aligned with one pair of diametrically opposed slots of the first type 410*a*' of the first group 410'. Although the third group of slots 418' and the first type of slots 110*a*' are described herein as separate slots, they can alternatively be viewed and function as a single slot in their final formation given the communication between the third group of slots 418' and the first type 410*a*' of slot. More preferably, the slots of the third group 418' are centered between slots of the third type 410*c*' of the first group 410'.

Each of the first and second through holes 414', 416' are also located on the blank 400' in a preferred orientation. More specifically, the first through hole 414' preferably includes two pairs of diametrically opposed through holes in which each through hole has its minor axis aligned with the orthogonal axes X-X, Z-Z of the first type of slots 410'*a* of the first group. The second group of through holes 416' preferably includes two pairs of diametrically opposed through holes in which their major axes are disposed on intersecting axes. More preferably, the second through holes are oriented such their major axes are disposed at a radial angle of about twenty-six degrees (26°) relative to the axis shared by the first type of slots 410*a*' of the first and group the slots of the third group 418'.

Once the diffuser element 400 is fabricated, it is installed about the distal end of the lower body element 22 of the frame 312. The diffuser element 400 is preferably installed with various slots and through holes oriented relative to the frame arms 318, 320. Preferably the third group of slots 418 are disposed orthogonal to a plane defined by the frame arms 318, 320 and the second type of slots 410*b* of the first group are disposed at a forty-five degree (45°) angle relative to the plane.

The diffuser element 400, alone or in combination with one or more of the arms 318, 320, and frame 312, provides the nozzle with the means for diffusing the fire retardant fluid in a spray pattern over an area to define a coverage area of the nozzle. Preferably, the frame 312 and diffuser element 400 cooperate to distribute a flow of fire retardant fluid from the upper body element 313 to define a preferred spray pattern. The spray pattern provides a preferred flux density for a given area beneath the nozzle in response to a given pressure of fluid supply when the nozzle is disposed at a specific height above floor of the area being protected. The preferred embodiment of the nozzle 30 is to be commercially embodied as an AQUAMIST® Nozzle: AM29. A draft data sheet is entitled, TFP2229: AQUAMIST® Nozzles: AM29 Automatic (Closed) (Draft Sep. 22, 2008) is included in U.S. Provisional Patent Application No. 61/193,875 which is incorporated by reference to incorporate the data sheet. The draft data sheet shows and describes preferred installation criteria for the preferred nozzle.

Each of the above preferred nozzles 100, 300 shown in FIGS. 2-18 successfully passed fire tests outlined in FM publication, *Approval Standard For Water Mist Systems: Class No.* 5560 (May 2005) (hereinafter "FM 5560"). More specifically, the preferred nozzles were tested in accordance with the tests detailed in Appendix I of FM 5560, entitled "APPENDIX I—Fire Tests for Water Mist Systems for Protection of Light Hazard Occupancies" (hereinafter "FM 5560: Appendix I"). Copies of FM 5560: Appendix I along with a description of the test results and the performance of the preferred nozzles 100, 300 are included in U.S. Provisional Application Nos. 61/193,874 and 61/193,875, each filed on Jan. 2, 2009, each of which is incorporated by reference to specifically incorporate the test results.

According to FM 5560: Appendix I, a "Small Compartment" fire test is conducted within a compartment SC having a bunk bed fuel package as shown in FIGS. 19A-21B. The Small Compartment residential fire test compartment measured—W×L×H—10 ft.×13 ft.×8 ft. (3 m×4 m×2.4 m) fitted with two total bunk beds, each located on the 13 ft. walls. Each bunk bed contained three total mattresses pieces of 6 ft.-6 in.×2 ft.-7 in.×4 in. (2 m by 0.8 m by 0.1 m) thick polyether foam commodity with a cotton fabric cover. Two mattresses were in a horizontal configuration and one was in a vertical configuration parallel to and against the wall. A total of four pillows, composed of the same material, were also required in the test, one at the head of each horizontal mattress. The entire compartment was protected by one nozzle 800*a* located centrally within the compartment SC.

One doorway, measuring 2 ft.-6 in (0.8 m.) wide×7 ft.-2 in. (2.2 m) high is located along one of the 10 ft. (3 m) wide walls. Along the same wall at the opposite end to the doorway is a lavatory space LS measuring 3.9 ft.×3.9 ft. (1.2 m.×1.2 m) that is not open to the compartment. The lavatory volume served to channel hot gases out of the compartment through the doorway. A 4.9 ft. (1.5 m) wide hallway HW s located directly outside the door, and oriented perpendicular to the direction of travel through the doorway. Two nozzles 800*b*, 800*c* total were located in the 2.4 meter ceiling of the hallway, one in each direction at the nozzle maximum spacing.

A test fire I is ignited in a lower bunk located 1.3 ft off the floor and 3 ft. beneath an upper bunk as shown. Passing test criteria for the Small Compartment fire test is: (i) maintain temperatures directly over ignition, at the ceiling, below 315C; (ii) maintain greater than 60% of mattress commodity in the ignition bunk; and (iii) do not operate nozzles located in the ceiling of the hallway. The mist nozzle 100 shown in FIGS. 2-10 was installed as test nozzle 800*a*, 800*b* and 800*c* and subjected to the Small Compartment test and passed. The test nozzle 800*a* was actuated approximately 150 seconds after ignition. At all times during the test, temperatures were maintained below 315C. One nozzle (out of one permitted) operated in the compartment. Zero nozzles (out of zero permitted) operated in the hallway. Greater than 60% of the mattress commodity in the bottom of the ignition bunk remained. Accordingly, the test was a success.

Figure 20:
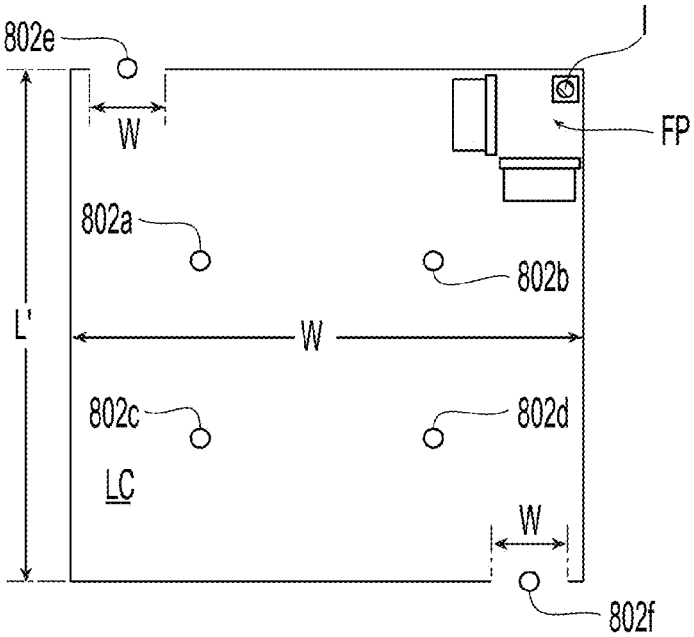
FIG. 20 is a schematic of a Large Compartment fire set up for fire testing of a preferred nozzle.

Another test under FM 5560: Appendix I is a Large Compartment residential fire test. The test is conducted in a compartment configured for the maximum nozzle to nozzle spacing of the test nozzle. For example, the test compartment for testing the to be commercialized AM 27 nozzle measures 32 ft.×32 ft. and the compartment for the AM 29 nozzle measures 24 ft.×24 ft. as shown in FIG. 20. The test compartment includes two doors, located in opposite corners each door measures 2 ft.-6 in (0.8 m.) wide and 7 ft.-2 in. (2.2 m) in height. The test compartment is fitted with four test nozzles 802*a*, 802*b*, 802*c*, 802*d* that are equally spaced at a maximum spacing of ½ of the nozzle to nozzle spacing. Two additional test nozzles 802*e*, 802*f* were also located on the ceiling, 100 mm inside the doors along the doorway centerline.

In one corner of the compartment is located a residential fuel package FP of a wood crib and simulated furniture. This fuel package includes two pieces of non-flame retardant, polyether foam commodity, 240 ml of commercial grade heptane and a wood crib of dimensions 12 in.×12 in×6 in (300 mm×300 mm×150 mm) in height. The walls of the fire corner are lined with 6 mm-thick plywood to form the fuel package FP. The crib is made of four layers of lumber with each layer being four 12 in. long pieces of 2 in.×2 in. kiln-dried or fir lumber. The lumber in each layer is placed at right angles to the adjacent layers. The individual wood members in each layer are evenly spaced along the 12 in. length and stapled to adjacent layers. The crib weight ranges from 5.5 to 7 lbs. The crib is conditioned at a temperature of about 220° F. for up to 72 hours. The crib is then stored at room temperature for at least four hours prior to the actual fire test. The crib is centered atop a nominal 12 in. (300 mm)×12 in. (300 mm)×4 in. (100 mm), 12 gauge steel pan located in a corner of the test enclosure 2 in. from each wall.

The simulated furniture is made of the foam cushions attached to a plywood backing supported by a steel frame. The cushions are two pieces of uncovered pure polypropylene oxide polyol, polyether foam having a density of 1.7 lb/ft.$^3$ to 1.9 lb/ft.$^3$ and measuring 34 in. (860 mm)×30 in. (760 mm)×3 in. (76 mm). The foam has a chemical heat of combustion of about 22 kJ/g and peak heat release rate of about 230 kW/m$^2$. Each foam cushion is fixed to a 35 in. (890 mm)×31 in. (790 mm)×0.5 (12.7 mm) plywood backing using an aerosol urethane foam adhesive. The foam is located so as to result in a 0.5 in. (13 mm) gap between the sides of the cushion and the backing and a 1 in. (25 mm) between the bottom of the cushion and the bottom of the backing. The foam cushion and plywood backing assembly is conditioned to about 70° F. and about 50% relative humidity for at least 24 hours prior to testing. The foam and plywood backing assembly are placed in a steel support frame that holds the assembly in the vertical position. The simulated furniture, wood crib, and steel plan are placed on a piece of noncombustible sheathing measuring 4 ft. (1.2 m)×4 ft (1.2 m)×0.25 ft. (6 mm). The air in the compartment LC is conditioned to an ambient temperature of 68° F. Two 6 in. (150 mm)×2 in. (50 mm)×1.25 in. (30 mm) bricks are placed on the cement board sheathing against the foam cushions. Two 6 in. (150 mm)×0.25 in (6 mm) diameter cotton wicks are soaked in Heptane. Sixteen ounces of water and eight ounces of Heptane are placed in the steel pan beneath the crib. Additional details of the fuel package FP are provided in the copy of FM 5560: Appendix I which is attached to U.S. Provisional Patent Application No. 61/193,874 which is incorporated by reference to incorporate the details of the fuel package.

The Heptane in the pan and the cotton wicks are ignited at an ignition point I in the corner by the fuel package. Successful test criteria is defined as: (i) maintain temperatures directly over ignition, at the ceiling, below 315C; (ii) do not operate nozzle, located inside each of the doorways. Each of the preferred nozzles 100, 300 were installed as the test nozzles 802*a*-802*f*. In the test results of the to-be-commercialized AM27 nozzle 100, operation of the test nozzle occurred approximately 90 seconds after ignition, and for the to-be-commercialized AM29 nozzle 300, nozzle operation occurred 80 seconds after ignition. The test was run for 10 minutes following nozzle operation. The test was a success. At all times during the test, temperatures were maintained below 315C, one nozzle (out of four permitted) operated in the compartment, and zero nozzles (out of zero permitted) operated inside the doorways.

A third type of fire test under FM 5560: Appendix I is entitled the Open Space fire test. An open space fire test was conducted under a 66 ft. (20 m)×82 ft. (25 m) ceiling set to a height of about 16 ft. (5 m). The ceiling was constructed of cellulose acoustical tiles oriented in a drop ceiling arrangement. Test nozzles 804 were installed at the maximum spacing of 12 ft. (3.66 m.). A total of 30 nozzles were installed in the ceiling.

Figure 21A:
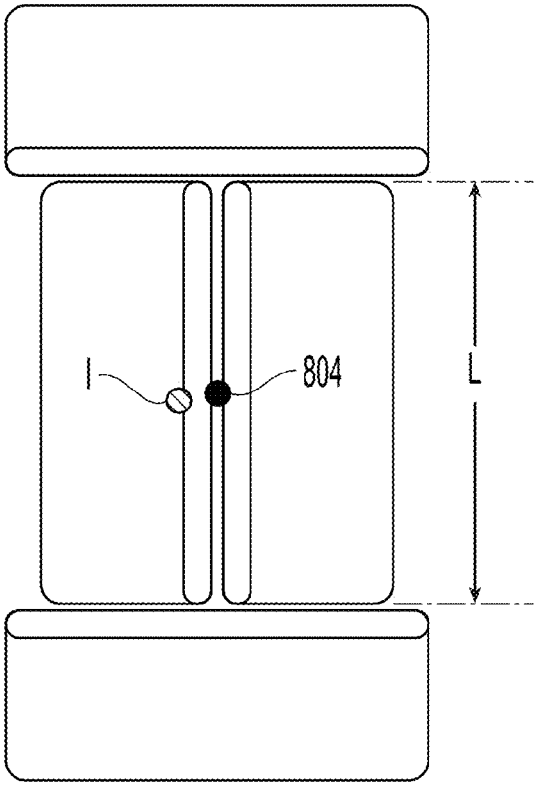
FIGS. 21A-21B is a schematic of an Open Space fire set up for the fire testing of a preferred nozzle.
Figure 21B:
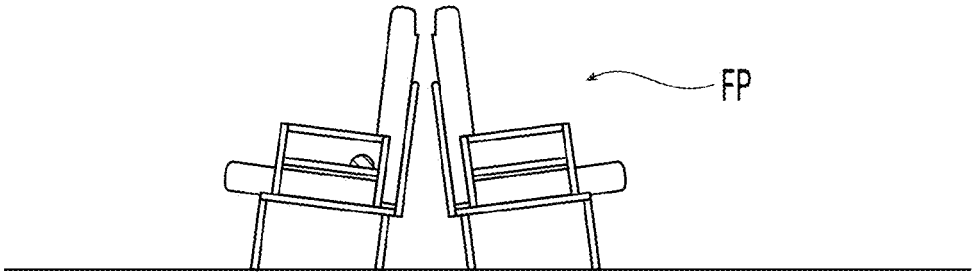

The fuel package, shown in FIGS. 21A and 21B includes four adjacent couches: two couches were arranged back to back, with one couch located centrally on either side of the base array. Each couch frame was constructed of angle iron and was covered with a horizontal and vertical 6.5 ft. (2 m)×2.6 ft. (0.8 m)×4 in. (0.1 m) thick piece of polyether foam commodity with a cotton fabric cover. The steel frames for the couches include rectangular bottom and backrest frames constructed of steel angels, channels or rectangular stock of that least 0.12 in. (3 mm.) thickness. The frame dimensions are 6.5 ft.×25.6 in. (2.0 m.×0.65 m). The seat and backrest cushions are supported on each frame by three steel bars 0.8-1.2 in (20-30 mm) wide×25.6 in (0.65 m) long spaced every 19.7 in. (0.5 m) and welded to the frames. Four legs support the assembled frame and are of similar stock. The two rear legs are 19.7 in. (500 mm) in height and the front legs are 22.8 (580-mm) in height. Each couch has rectangular armrest on each end. The armrest is constructed of similar steel stock and 7.9 in. (0.2 m) in height and 19.7 (0.5 m) in length. The rear section of the armrest is attached to the bottom frame 2.0 in. (50 mm.) from the backrest.

In a first open space test, the fuel package is centered under one of the test nozzles 804 installed in the ceiling, and the ignition point I is located atop the center of one of the sofas in the fuel package. Operation of the nozzle occurred approximately 160 seconds after ignition. The test was run for 10 minutes following operation of the first nozzle. Criteria for success is defined by: (i) maintain temperatures directly over ignition, at the ceiling, below 315C; (ii) maintain greater than 50% of mattress commodity; and (iii) do not operate more than five nozzles. For the nozzle 300 to-be-commercialized as the AM29, at all times during the test, temperatures were maintained below 315C. Greater than 50% of the mattress commodity remained after testing. One nozzle (out of 5 permitted) operated in the ceiling, 5 m above the fuel package arrangement. The fire test was a success.

In a second open space test, the fuel package was centered between two nozzles. Operation of the first nozzle occurred approximately 200 seconds after ignition. The test was run for 10 minutes following operation of the first nozzle. The test satisfied successful testing criteria. In a third open space fire test, the fuel package was centered between four nozzles. Operation of the first nozzle occurred approximately 210 seconds after ignition. The test was run for 10 minutes following operation of the first nozzle. Again, the test nozzles successfully satisfied the test criteria.

Figure 22:
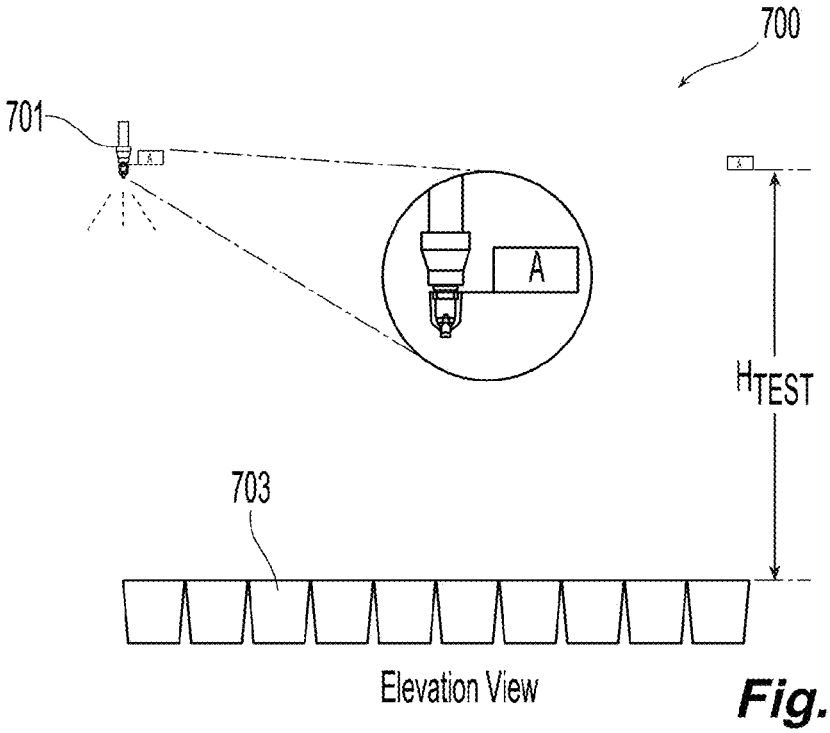
FIGS. 22-23 is a schematic of a preferred spray distribution test set up.
Figure 23:
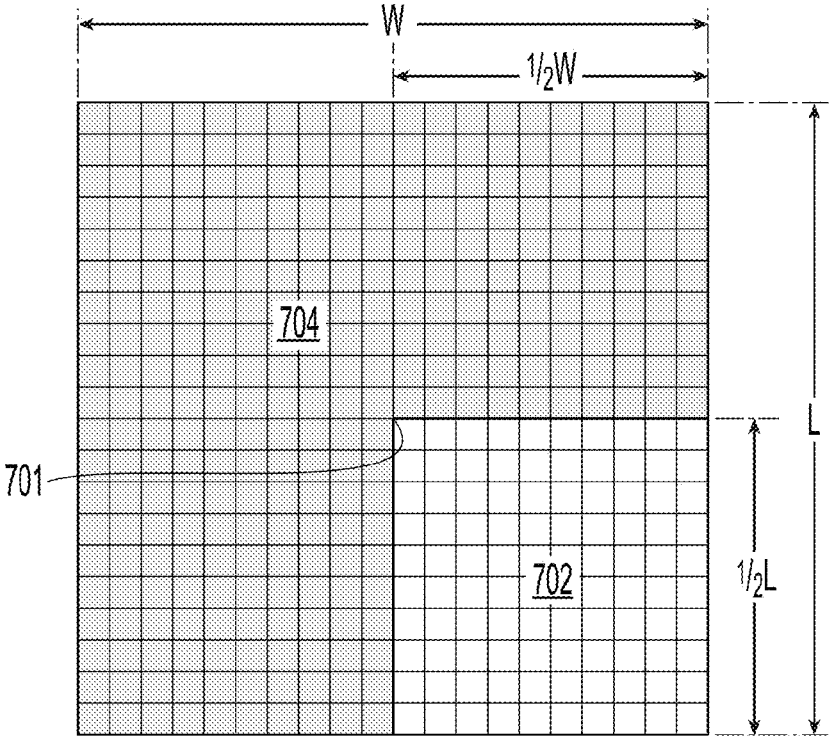

Another preferred method to characterize a water mist nozzle is by conducting distribution spray testing in which water is collected over a specified area and period of time for determination of the effective flux density, flow volume and/or percentage of total flow from the nozzle. For this testing, water collection buckets are arranged in a grid beneath a test nozzle installed at a test height $H_{TEST}$ 78 inches above the buckets 703 as measured from the top of the wrench boss of the nozzle body. The test installation 700 is schematically shown in FIG. 22. Each of the above described preferred nozzles 100, 300 were installed in the test set up as test nozzle 701. In order to determine the entire spray pattern about a test nozzle 701, 25% or one quarter of a 20'×20' grid area (400 sq. ft.) beneath the nozzle was evaluated. Accordingly, one hundred collection buckets were installed to capture one "quadrant" of the spray pattern distribution from a test nozzle. Shown in FIG. 23 is a schematic plan view in which the one hundred collection buckets 703 are located in a 120 inch×120 inch quadrant region 702 beneath the test nozzle. To evaluate the complete spray distribution from a test nozzle 18, water collection data from region 702 is transposed into the remaining quadrant region 704 for calculation and visualization purposes. This approach was proven valid through the process of comparing the water collected in the buckets to the total known flow through the nozzle.

With the nozzle installed above the collection buckets, water is supplied and allowed to flow through the test nozzle 701 at a controlled and predetermined pressure for some amount of time. The test pressures included: 100 psi., 175 psi. and 245 psi. The duration for testing was variable based on actual flow time through the nozzle. More specifically, flow was continuous until a measurable amount of water was collected in some of the buckets. At no time was water allowed to overflow from any one bucket.

The spray pattern for mist nozzles and more particularly low pressure nozzles, preferably have discrete directional spray components required for successful performance during fire testing. For example, a spray pattern in which there is a concentration in a forty-five degree direction off of the plane defined by the nozzle frame arms. These directional components preferably consist mostly of relatively large diameter, high momentum droplets which entrain relatively small diameter, low momentum droplets into their flow path. The resulting characteristic in the preferred spray pattern for each low pressure water mist nozzle consists of both relatively small and large droplets, the former being affected by the latter. Additional characteristics of the spray pattern include water droplets that "fall out" of the directional spray pattern, either by way of turbulence, coagulation, or a combination of both effects. Due to the directional spray characteristics of the subject low pressure nozzles, some buckets in the grid filled quickly, while others took much longer. As such, it was necessary to expose parts of the grid to different periods of flow.

The test set up was constructed such that the flow through the nozzle can be stopped and the buckets measured. The metric for measuring is termed "flux density", which has the units [gallon per minute per square foot] and aptly describes the volume of water delivered to each bucket having a 1'×1' opening. This metric also allows the ability to make accurate measurements of spray pattern distribution and also allows for variable time frames. After a first round of buckets had been measured, they were emptied and removed from the grid and testing continued. This process was repeated until a volume of water in each bucket was measurable. The total elapsed time is also recorded per bucket. A bucket may also be deemed to be outside the limits of the spray pattern if after a sufficient time there is no water collection; boundaries of the spray pattern are found in this way. The water collection raw data for each bucket in the test quadrant 702 is correspondingly mirrored to replicate the remaining three quadrants 704 about the nozzle.

The flux density measurement is not made directly, but is instead derived. A meter was used for individual bucket depth measurement for the range of buckets in the grid. Known volumes of water (1 gallon, 2 gallons, etc.) were poured into sample buckets of identical shape factor. The resulting depths were measured with the same convenient meter and a correlation was developed between depth on the meter and volume collected. These resulting water measurements, when coupled with collection time describe the delivered flux density for each bucket in the grid. For these "flux density meters," each demarcation on the stick identifies the volume of water delivered per square foot.

A theoretical total volume of water passing through the test nozzle 701 is known based on characteristic k-factor [GPM/psi$^{1/2}$] and pressure [psi] by utilizing the following equation:

$$Q=k*\sqrt{P}$$

From the collection data a total volume of discharge is calculated by summing the discharge volumes for the entire extrapolated grid of 400 square feet. The collected volume of water and the theoretical volume of water delivered through the nozzle can then be compared. It can be shown that the accuracy of the water collection method for determining volume discharge from the nozzle is approximately 93% and preferably as high as 99% of the theoretical output of the nozzle.

The collection data can be alternately visualized to show discharge distribution data. For example, freeware called 'SE.LA.VI.: Scientific Lab for Visualization, available at URL Address<http://www.fluid.mech.ntua.gr/selavi/>, can be used to provide a visual representation of spray pattern distribution. The software converts the discharge distribution into a visual pattern that indicates heavy discharge with yellow and red colors with decreasing areas of discharge concentration shown in green and/or blue. More specifically, the color red in the pattern represents the highest concentration and dark blue represents zero flux density delivered. Light blue, green and yellow represents respectively, less to more concentration in the discharge distribution. Color copies of the test distribution result were filed in U.S. Provisional Application No. 61/193,874, filed on Jan. 2, 2009 and U.S. Provisional Application No. 61/193,875, filed on Jan. 2, 2009.

Figure 24:
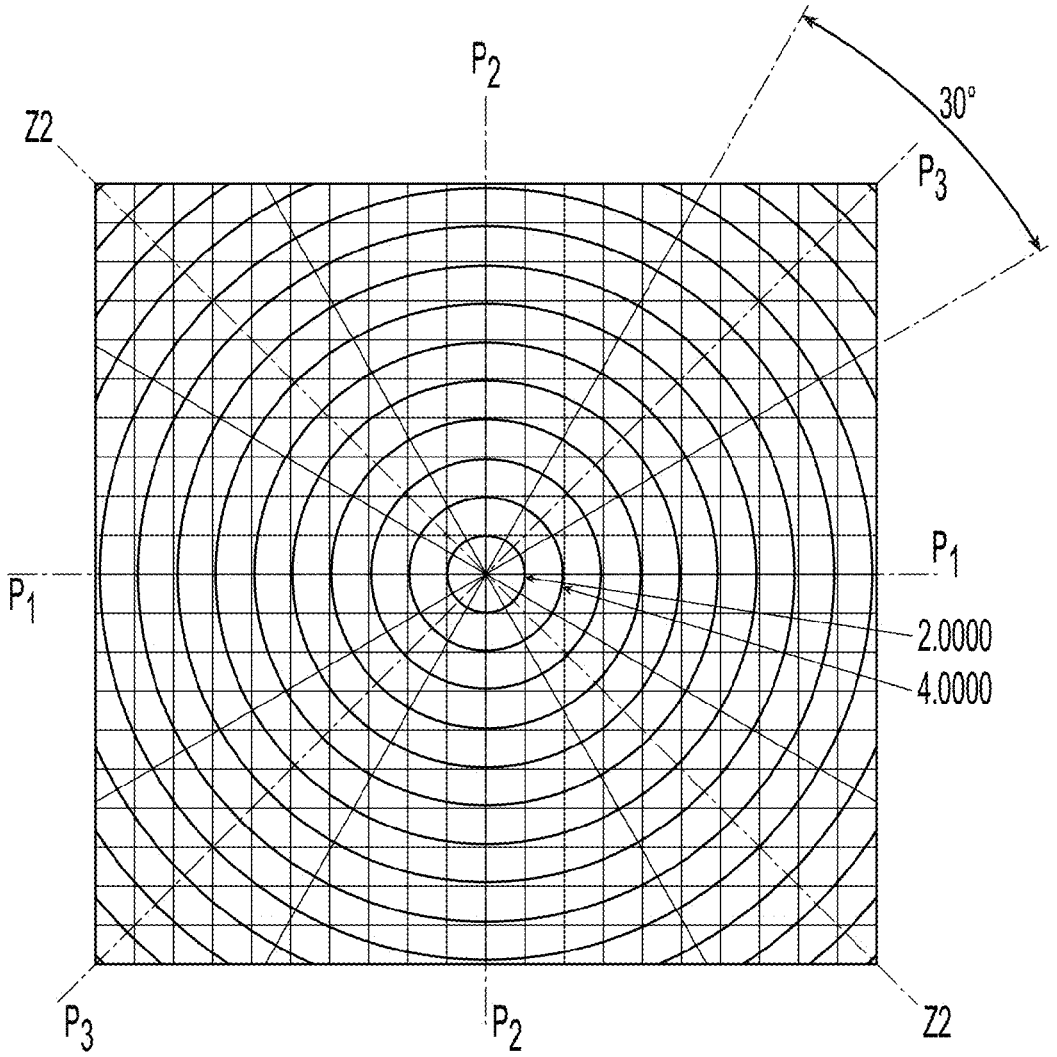
FIG. 24 is a preferred polar coordinate system for analysis of spray pattern of a nozzle of FIGS. 2 and 11.

The rectilinear or Cartesian grid of distribution data is further preferably converted into a Polar Coordinate system as shown in FIG. 24. The entire nozzle spray pattern is preferably defined by a Polar Coordinate system having its origin at the nozzle axis with its peripheral boundary at a diameter about the nozzle of twenty feet. The spray pattern is further preferably divided into concentric annular rings about the test nozzle defining discrete regions of the spray pattern. Each ring is preferably defined by an inner ring edge defining an inner diameter about the device axis and an outer ring edge defining an outer diameter about the device axis. The inner and outer ring edges are spaced apart by one foot in the radial direction. Summarized in Tables 3A-3C and Tables 4A-4C are the distribution values for each discrete annular band identified by the inner and outer diameter of the rings. More specifically, each ring shows the discrete volumetric flow measured in gallons per minute, percentage of total flow and the cumulative volume between the nozzle axis. Tables 4A-4C are the test results for the nozzle shown in FIGS. 2-10, the to-be-commercialized AM27 nozzle. Tables 4A-4C are the test results for the nozzle shown in FIGS. 11-18, the to-be-commercialized AM29 nozzle.

To further facilitate analysis of the test results the results, the polar and Cartesian distribution data is dissected into zones: Zone 1 Z1; Zone 2 Z2; and Zone 3 Z3 as shown in FIG. 24. The preferably three zones allow for a more detailed analysis of the distribution of a given sector within the polar coordinate region of a given quadrant of the distribution. Zone one Z1 is defined by a sixty degree span about a first plane P1-P1 intersecting the device axis and perpendicular to a second plane P2-P2 intersecting the device axis and including the pair of frame arms. Zone three Z3 is defined by a sixty degree span centered about the second plane, and zone two Z2 is defined by a thirty degree span about a third plane intersecting the device axis and disposed between the first and second planes and extending forty-five degrees relative to each of the first and second planes. In the summary tables below, Tables 3A-3C and Tables 4A-4C the volumetric flow and percentage of total flow is shown for each discrete region of an annular ring for a given zone. The numerical values of fluid flow and percent flow were experimentally determined and derived for preferred embodiments of water mist devices. Accordingly, it should be understood that equivalent performance for a test nozzle is possible despite variability in numerical values provided the profile of the fluid distribution for the subject nozzle is relatively substantially similar.

Referring to the test results provided below and in particular the results in Zone 2 Z2 show that the subject nozzles provide for a volumetric flow at radial distances from the nozzles that is greater than those of previously known nozzles. Accordingly, the test shows the enlarged coverage area performance of the subject nozzles. Moreover, the test results show the maximum fluid flow distribution and cumulative percent flow distribution over a discrete radial region or cumulative radial regions. For example, the preferred nozzle 300 when installed in the test installation 700 with an inlet pressure of 175 psi, Table 4B shows that the resultant spray pattern includes: (i) within zone 1 Z1 the highest percentage of the flow volume in a first region 8 ft. to 10 ft. about the device axis and about 15% of the total flow being distributed over a second region eight to twenty feet about the device axis; (ii) within zone 2 the highest percentage of the flow volume in a first region 12 ft. to 14 ft. about the device axis and about 18% of the total flow being distributed over a second region twelve to twenty feet about the device axis; and (iii) within zone 3 the highest percentage of the flow volume in a first region 6 ft. to 8 ft. about the device axis and about 11% of the total flow being distributed over a second region six to twenty feet about the device axis. Such nozzle performance provides for the reduced water demand requirements in mist-type fire protections systems for light and ordinary occupancies as compared to known sprinkler or mist systems. Further details of the distribution testing and analysis is described in U.S. Provisional Application No. 61/193,874, filed on Jan. 2, 2009 and U.S. Provisional Application No. 61/193,875, filed on Jan. 2, 2009 each of which is incorporated by reference to specifically incorporate the details of the distribution testing and analysis.

TABLE 3A

| Pressure = 100 psi. | | | | ZONE 1 | | ZONE 2 | | ZONE 3 | |
|---|---|---|---|---|---|---|---|---|---|
| Ring Dia. (Outer) | Volume (gpm) | Cumulative Volume (gpm) | Percentage of Total (%) | Volume (gpm) | Percentage of Total (%) | Volume (gpm) | Percentage of Total (%) | Volume (gpm) | Percentage of Total (%) |
| 0 ft.-2 ft. | 0.07 | 0.07 | 0.8 | 0.0+ | 0.3 | 0.0+ | 0.3 | 0.0+ | 0.3 |
| 2 ft.-4 ft. | 0.25 | 0.32 | 3.1 | 0.1 | 0.9 | 0.1 | 1.3 | 0.1 | 1.0 |
| 4-ft.-6 ft. | 1.41 | 1.73 | 17.4 | 0.3 | 3.2 | 0.4 | 4.4 | 0.2 | 2.5 |
| 6 ft.-8 ft. | 0.87 | 2.60 | 10.8 | 0.3 | 3.3 | 0.9 | 10.6 | 0.2 | 2.7 |
| 8 ft.-10 ft. | 1.31 | 3.91 | 16.2 | 0.4 | 4.7 | 0.8 | 9.5 | 0.3 | 3.4 |
| 10 ft.-12 ft. | 0.90 | 4.81 | 11.1 | 0.3 | 3.3 | 0.5 | 6.1 | 0.2 | 2.0 |
| 12 ft.-14 ft. | 0.92 | 5.72 | 11.3 | 0.2 | 2.9 | 0.5 | 5.7 | 0.2 | 2.6 |
| 14 ft.-16 ft. | 0.71 | 6.43 | 8.7 | 0.1 | 1.1 | 0.5 | 5.9 | 0.2 | 1.9 |
| 16 ft.-18 ft. | 0.60 | 7.03 | 7.3 | 0.1 | 0.8 | 0.4 | 4.6 | 0.1 | 1.5 |
| 18 ft.-20 ft. | 0.35 | 7.37 | 4.3 | 0.0+ | 0.3 | 0.3 | 3.4 | 0.1 | 0.7 |

TABLE 3B

| Pressure = 175 psi. | | | | ZONE 1 | | ZONE 2 | | ZONE 3 | |
|---|---|---|---|---|---|---|---|---|---|
| Ring Dia. (Outer) | Volume (gpm) | Cumulative Volume (gpm) | Percentage of Total (%) | Volume (gpm) | Percentage of Total (%) | Volume (gpm) | Percentage of Total (%) | Volume (gpm) | Percentage of Total (%) |
| 0 ft.-2 ft. | 0.18 | 0.18 | 1.64 | 0.1 | 0.5 | 0.1 | 0.5 | 0.1 | 0.5 |
| 2 ft.-4 ft. | 0.53 | 0.71 | 4.96 | 0.2 | 1.4 | 0.2 | 2.2 | 0.2 | 1.6 |
| 4-ft.-6 ft. | 2.08 | 2.79 | 19.39 | 0.5 | 4.2 | 0.6 | 5.6 | 0.4 | 3.4 |
| 6 ft.-8 ft. | 1.37 | 4.16 | 12.82 | 0.5 | 4.3 | 1.1 | 10.5 | 0.3 | 2.6 |
| 8 ft.-10 ft. | 1.68 | 5.84 | 15.72 | 0.8 | 7.0 | 0.9 | 8.1 | 0.3 | 2.4 |
| 10 ft.-12 ft. | 1.36 | 7.20 | 12.69 | 0.5 | 4.9 | 0.7 | 6.4 | 0.1 | 1.4 |
| 12 ft.-14 ft. | 0.92 | 8.12 | 8.57 | 0.2 | 2.1 | 0.5 | 4.3 | 0.2 | 1.7 |
| 14 ft.-16 ft. | 0.60 | 8.72 | 5.58 | 0.1 | 0.7 | 0.4 | 4.1 | 0.1 | 1.0 |
| 16 ft.-18 ft. | 0.66 | 9.38 | 6.15 | 0.0+ | 0.2 | 0.5 | 4.9 | 0.1 | 0.6 |
| 18 ft.-20 ft. | 0.62 | 10.00 | 5.77 | 0.0+ | 0.1 | 0.6 | 5.4 | 0.0+ | 0.3 |

TABLE 3C

| Pressure = 245 psi. | | | | ZONE 1 | | ZONE 2 | | ZONE 3 | |
|---|---|---|---|---|---|---|---|---|---|
| Ring Dia. (Outer) | Volume (gpm) | Cumulative Volume (gpm) | Percentage of Total (%) | Volume (gpm) | Percentage of Total (%) | Volume (gpm) | Percentage of Total (%) | Volume (gpm) | Percentage of Total (%) |
| 0 ft.-2 ft. | 0.15 | 0.15 | 1.18 | 0.0+ | 0.4 | 0.0+ | 0.4 | 0.0+ | 0.4 |
| 2 ft.-4 ft. | 0.40 | 0.54 | 3.11 | 0.1 | 0.9 | 0.2 | 1.4 | 0.1 | 1.0 |
| 4-ft.-6 ft. | 1.57 | 2.11 | 12.39 | 0.3 | 2.6 | 0.4 | 3.5 | 0.3 | 2.3 |
| 6 ft.-8 ft. | 0.99 | 3.10 | 7.77 | 0.3 | 2.5 | 0.8 | 6.6 | 0.2 | 1.9 |
| 8 ft.-10 ft. | 1.07 | 4.17 | 8.45 | 0.4 | 2.9 | 0.6 | 4.5 | 0.2 | 1.9 |
| 10 ft.-12 ft. | 0.75 | 4.92 | 5.94 | 0.3 | 2.3 | 0.3 | 2.4 | 0.1 | 1.1 |
| 12 ft.-14 ft. | 0.66 | 5.58 | 5.18 | 0.3 | 1.7 | 0.3 | 2.2 | 0.2 | 1.3 |
| 14 ft.-16 ft. | 0.58 | 6.16 | 4.54 | 0.1 | 0.8 | 0.4 | 3.1 | 0.1 | 0.8 |
| 16 ft.-18 ft. | 0.61 | 6.76 | 4.79 | 0.0+ | 0.2 | 0.5 | 3.6 | 0.1 | 0.6 |
| 18 ft.-20 ft. | 0.58 | 7.33 | 4.45 | 0.0+ | 0.1 | 0.5 | 3.9 | 0.1 | 0.5 |

TABLE 4A

| Pressure = 100 psi. | | | | ZONE 1 | | ZONE 2 | | ZONE 3 | |
|---|---|---|---|---|---|---|---|---|---|
| Ring Dia. (Outer) | Volume (gpm) | Cumulative Volume (gpm) | Percentage of Total (%) | Volume (gpm) | Percentage of Total (%) | Volume (gpm) | Percentage of Total (%) | Volume (gpm) | Percentage of Total (%) |
| 0 ft.-2 ft. | 0.15 | 0.15 | 2.5 | 0.0+ | 0.8 | 0.0+ | 0.8 | 0.0+ | 0.8 |
| 2 ft.-4 ft. | 0.23 | 0.38 | 4.0 | 0.1 | 1.1 | 0.1 | 1.9 | 0.1 | 1.3 |
| 4-ft.-6 ft. | 0.48 | 0.86 | 8.1 | 0.1 | 1.5 | 0.2 | 2.6 | 0.2 | 3.2 |
| 6 ft.-8 ft. | 0.57 | 1.43 | 9.6 | 0.1 | 2.4 | 0.2 | 3.2 | 0.2 | 3.9 |
| 8 ft.-10 ft. | 0.61 | 2.04 | 10.4 | 0.2 | 3.8 | 0.2 | 3.3 | 0.2 | 4.0 |
| 10 ft.-12 ft. | 0.66 | 2.70 | 11.2 | 0.2 | 4.0 | 0.3 | 5.2 | 0.1 | 2.3 |
| 12 ft.-14 ft. | 0.78 | 3.48 | 13.2 | 0.3 | 4.4 | 0.4 | 6.2 | 0.1 | 2.0 |
| 14 ft.-16 ft. | 0.67 | 4.15 | 11.4 | 0.2 | 4.0 | 0.4 | 6.5 | 0.1 | 1.5 |
| 16 ft.-18 ft. | 0.68 | 4.83 | 11.6 | 0.2 | 3.7 | 0.4 | 6.5 | 0.0+ | 0.8 |
| 18 ft.-20 ft. | 0.56 | 5.39 | 9.4 | 0.2 | 3.1 | 0.4 | 6.3 | 0.0+ | 0.2 |

TABLE 4B

| Pressure = 175 psi. | | | | ZONE 1 | | ZONE 2 | | ZONE 3 | |
|---|---|---|---|---|---|---|---|---|---|
| Ring Dia. (Outer) | Volume (gpm) | Cumulative Volume (gpm) | Percentage of Total (%) | Volume (gpm) | Percentage of Total (%) | Volume (gpm) | Percentage of Total (%) | Volume (gpm) | Percentage of Total (%) |
| 0 ft.-2 ft. | 0.31 | 0.31 | 3.91 | 0.1 | 1.2 | 0.1 | 1.2 | 0.1 | 1.2 |
| 2 ft.-4 ft. | 0.61 | 0.61 | 7.76 | 0.2 | 2.8 | 0.3 | 3.4 | 0.2 | 2.3 |
| 4-ft.-6 ft. | 0.64 | 1.55 | 8.16 | 0.3 | 3.8 | 0.2 | 2.9 | 0.2 | 3.1 |
| 6 ft.-8 ft. | 1.04 | 2.59 | 13.37 | 0.3 | 4.2 | 0.2 | 3.0 | 0.3 | 3.6 |
| 8 ft.-10 ft. | 0.85 | 3.44 | 10.91 | 0.4 | 4.6 | 0.3 | 3.8 | 0.3 | 3.4 |
| 10 ft.-12 ft. | 0.82 | 4.26 | 10.48 | 0.2 | 3.1 | 0.5 | 6.8 | 0.1 | 1.5 |
| 12 ft.-14 ft. | 0.97 | 5.23 | 12.43 | 0.2 | 3.2 | 0.5 | 6.9 | 0.1 | 1.1 |
| 14 ft.-16 ft. | 0.60 | 5.83 | 7.65 | 0.2 | 2.3 | 0.4 | 5.1 | 0.1 | 0.8 |
| 16 ft.-18 ft. | 80.79 | 6.31 | 8.11 | 0.1 | 1.4 | 0.3 | 3.7 | 0.0+ | 0.6 |
| 18 ft.-20 ft. | 83.69 | 6.53 | 2.90 | 0.1 | 0.7 | 0.1 | 1.9 | 0.0+ | 0.3 |

TABLE 4C

| Pressure = 245 psi. | | | | ZONE 1 | | ZONE 2 | | ZONE 3 | |
|---|---|---|---|---|---|---|---|---|---|
| Ring Dia. (Outer) | Volume (gpm) | Cumulative Volume (gpm) | Percentage of Total (%) | Volume (gpm) | Percentage of Total | Volume (gpm) | Percentage of Total | Volume (gpm) | Percentage of Total (%) |
| 0 ft.-2 ft. | 0.24 | 0.24 | 2.54 | 0.1 | 0.8 | 0.1 | 0.8 | 0.1 | 0.8 |
| 2 ft.-4 ft. | 0.41 | 0.64 | 4.39 | 0.1 | 1.2 | 0.2 | 2.2 | 0.1 | 1.3 |
| 4-ft.-6 ft. | 0.77 | 1.41 | 8.30 | 0.1 | 1.6 | 0.3 | 3.0 | 0.3 | 3.2 |
| 6 ft.-8 ft. | 0.78 | 2.19 | 8.45 | 0.1 | 1.6 | 0.3 | 2.9 | 0.4 | 3.8 |
| 8 ft.-10 ft. | 0.72 | 2.91 | 7.83 | 0.3 | 2.9 | 0.2 | 2.2 | 0.3 | 3.4 |
| 10 ft.-12 ft. | 0.76 | 3.66 | 8.17 | 0.4 | 3.9 | 0.3 | 3.0 | 0.1 | 1.6 |
| 12 ft.-14 ft. | 1.14 | 4.80 | 12.34 | 0.5 | 5.4 | 0.5 | 5.1 | 0.1 | 1.2 |
| 14 ft.-16 ft. | 1.24 | 6.04 | 13.42 | 0.4 | 4.6 | 0.8 | 9.1 | 0.1 | 0.8 |
| 16 ft.-18 ft. | 1.21 | 7.26 | 13.12 | 0.3 | 3.4 | 0.8 | 8.3 | 0.0+ | 0.5 |
| 18 ft.-20 ft. | 0.71 | 7.97 | 7.70 | 0.2 | 2.1 | 0.5 | 5.3 | 0.0+ | 0.4 |

While the present invention has been disclosed with reference to certain preferred embodiments, numerous modifications, alterations, and changes to the described embodiments are possible without departing from the sphere and scope of the present invention, as described herein.

The invention claimed is:

1. A mist system for fire protection of a light and ordinary hazard occupancy, the system comprising:

a fluid supply; and a plurality of nozzles spaced about the light and ordinary hazard occupancy and coupled to the fluid supply so as to provide fluid to the nozzles at an operating pressure of less than about 500 pounds per square inch (psi) and define a hydraulic demand being the greater of:

(i) five hydraulically remote nozzles each having a coverage area ranging from 36 sq. ft. to a maximum of about 256 sq. ft; or (ii) a hydraulic design area ranging from about 900 square feet to about 1044 square feet; wherein the plurality of nozzles includes at least one of:

(a) a first mist device comprising:

a body having an upper portion and a lower portion, the upper portion defining an internal passage having an inlet and an outlet for the discharge of a fluid to define a K-factor of less than 1 gpm/ $psi^{1/2}$, the upper and lower portions being axially spaced and aligned along a device axis;

a pair of frame arms extending between the upper and lower body portion and centered about the device axis;

a seal assembly disposed in the outlet including a thermally sensitive element to support the seal assembly; and a diffuser element, the diffuser element being disposed about a distal end of the lower portion of the body externally of the frame arms centrally aligned along the device axis, the diffusing element including:

an upper surface and a lower surface spaced from and extending substantially parallel to the upper surface, the upper surface defining a central region and an outer region each disposed substantially perpendicular to the device axis, the upper surface further defining an intermediate region extending at an angle to each of the central and peripheral regions to space the central and peripheral regions axially apart, the upper surface extending about the device axis so as to define a truncated cone about the device axis; and a plurality of slots and a plurality of through holes extending from the upper surface to the lower surface, each of the plurality of slots having a slot opening along the outer region and extending radially inward toward the device axis to define a slot length, an initial portion, an intermediate portion and a terminal portion, each of the plurality of slots defining slot widths from the initial to the terminal portion; wherein the plurality of slots include a first group of slots and at least a second group of slots, the slot width of the first group of slots varying along the slot length, the slot width of the second group of slots being constant along the slot lengths;

and (b) a second mist device comprising:

a body having an upper portion and a lower portion, the upper portion defining an internal passage having an inlet and an outlet for the discharge of a fluid to define a K-factor of less than 1 gpm/ $psi^{1}/_{2}$, the upper and lower portions being axially spaced and aligned along a device axis;

a pair of frame arms extending between the upper and lower body portion and centered about the device axis;

a seal assembly disposed in the outlet including a thermally sensitive element to support the seal assembly;

a diffuser assembly including:

a load screw engaged with the lower body portion; and a diffuser element disposed atop the load screw so as to be located between the upper and lower portions of the body internally of the frame arms centrally aligned along the device axis, the diffuser element including:

an upper surface and a lower surface, the upper surface including a central cone portion extending proximally toward the outlet of the passageway; a plurality of through holes; wherein each through hole being defined by a pair of circles partially overlapping one another, the pair of circles having different diameters so as to form a key-hole shaped through hole.

2. A mist device comprising:

a body having an upper portion and a lower portion, the upper portion defining an internal passage having an inlet and an outlet for the discharge of a fluid to define a K-factor of less than 1 gpm/ $psi^{1/2}$, the upper and lower portions being axially spaced and aligned along a device axis;

a pair of frame arms extending between the upper and lower body portion and centered about the device axis;

a seal assembly disposed in the outlet including a thermally sensitive element to support the seal assembly; and a diffuser element, the diffuser element being disposed about a distal end of the lower portion of the body externally of the frame arms centrally aligned along the device axis, the diffusing element including:

an upper surface and a lower surface spaced from and extending substantially parallel to the upper surface, the upper surface defining a central region and an outer region each disposed substantially perpendicular to the device axis, the upper surface further defining an intermediate region extending at an angle to each of the central and peripheral regions to space the central and peripheral regions axially apart, the upper surface extending about the device axis so as to define a truncated cone about the device axis; and at least one of a plurality of slots and a plurality of through holes extending from the upper surface to the lower surface, each of the plurality of slots having a slot opening along the outer region and extending radially inward toward the device axis to define a slot length, an initial portion, an intermediate portion and a terminal portion, each of the plurality of slots defining slot widths from the initial to the terminal portion;

wherein the plurality of slots includes a first group of slots and at least a second group of slots, the slot width of the first group of slots varying along the slot length, the slot width of the second group of slots being constant along the slot lengths.

3. The device of claim 2, wherein the first group of slots includes radiused portions in the terminal portion of the slot, the radiused portions being spaced apart such that the slot width of the terminal portion is wider than the slot width in the initial and intermediate portions, the first group of slots being radially disposed about the device axis, the first group of slots including a first type of slot, a second type of slot, and a third type of slot, the first type of slots being centered along a first axis aligned with the frame arms and centered along a second axis perpendicular to the first axis, the second type of slots having a slot width wider at the terminal portion that is wider than the slot width of the terminal portion of the first type of slot, the second type of slot being centered along a third axis disposed at a 45 degree angle between the first and second axes, the third type of slots having a slot width at the terminal portion that is smaller than the slot width of the terminal portion of the first type of slot, the third type of slot being disposed between the second type of slot and the first type of slot disposed along the first axis, a slot of the second group being disposed between the second type of slot and the first type of slot disposed along the second axis.

4. The device of claim 3, wherein the diffuser element of the plurality of slots includes a third group of slots having an initial portion in communication with a first type of slot disposed along the first axis, the slot width of the third type of slots widening from the initial portion to the terminal portion of the slots.

5. The device of claim 4, wherein the third group of slots are aligned with the pair of frame arms such that the second type of slots are disposed at a forty-five degree angle relative to the pair of frame arms.

6. The device of claim 2, wherein each of the plurality of through holes is elongated to define a major axis and a minor axis, each of the through holes including a pair of radiused end portions having centers of curvature spaced along a major axis, the plurality of through holes including a first group of through holes and at least a second group of through holes, the pair of radiused end portions of the first group of through holes having equal radii, the pair of radiused end portions of the second group of through holes having varying radii.

7. The device of claim 2, wherein the central region has a central bore for engaging the lower portion of the body.

8. The device of claim 2, further including an orifice insert disposed within the passageway distally of the inlet to define the K-factor, the K-factor ranging between 0.5 to about 0.7 gpm/$psi^{1/2}$.

9. The device of claim 8, wherein the K-factor is 0.59 gpm/$psi^{1/2}$.

10. A mist device comprising:

a body having an upper portion and a lower portion, the upper portion defining an internal passage having an inlet and an outlet for the discharge of a fluid to define a K-factor of less than 1 gpm/ $psi^{1/2}$, the upper and lower portions being axially spaced and aligned along a device axis;

a pair of frame arms extending between the upper and lower body portions and centered about the device axis;

a seal assembly disposed in the outlet including a thermally sensitive element to support the seal assembly;

a diffuser assembly including:

a load screw engaged with the lower body portion; and a diffuser element disposed atop the load screw so as to be located between the upper and lower portions of the body internally of the frame arms centrally aligned along the device axis, the diffuser element including:

an upper surface and a lower surface, the upper surface including a central cone portion extending proximally toward the outlet of the passageway; and a plurality of through holes;

wherein each through hole being defined by a pair of circles partially overlapping one another, the pair of circles having different diameters so as to form a key-hole shaped through hole.

11. The device of claim 10, wherein the plurality of through holes includes a first pair of diametrically opposed through holes, a second pair of diametrically opposed through holes disposed perpendicular to the first pair.

12. The device of claim 11, wherein each of the first and second pair of through holes are disposed at a forty-five degree angle relative to the pair of frame arms.

13. The device of claim 10, further comprising a plurality of touchdown regions, each touchdown region surrounding a through hole.

14. The device of claim 10, further comprising a plurality of channels formed along the upper surface and radially disposed about the cone so as to define converging adjacent channels and adjacent diverging channels, the adjacent converging channels having an overlapping portion such that the adjacent converging channels are in communication with one another, a through hole and touchdown being centered between adjacent diverging channels.

15. The device of claim 10, further including an orifice insert disposed within the passageway distally of the inlet to define the K-factor, the K-factor ranging between 0.7 to about 0.9 gpm/psi$^{1/2}$.

16. The device of claim 10, wherein the K-factor is 0.81 gpm/psi$_{1/2}$.

* * * * *